US007501997B2

(12) United States Patent
Suzuki et al.

(10) Patent No.: US 7,501,997 B2
(45) Date of Patent: Mar. 10, 2009

(54) METHOD OF DRIVING A DISPLAY PANEL

(75) Inventors: Masahiro Suzuki, Yamanashi-ken (JP); Tetsuya Shigeta, Tokyo (JP)

(73) Assignee: Pioneer Corporation, Tokyo (JP)

( * ) Notice: Subject to any disclaimer, the term of this patent is extended or adjusted under 35 U.S.C. 154(b) by 643 days.

(21) Appl. No.: 11/176,471

(22) Filed: Jul. 8, 2005

(65) Prior Publication Data

US 2006/0007068 A1 Jan. 12, 2006

(30) Foreign Application Priority Data

Jul. 8, 2004 (JP) ..... 2004-201669
Mar. 15, 2005 (JP) ..... 2005-073009

(51) Int. Cl.
*G09G 3/28* (2006.01)

(52) U.S. Cl. ..... 345/60; 345/690; 345/89; 315/169.4

(58) Field of Classification Search ..... 345/60, 345/63, 66–68, 74.1, 89, 690–691; 315/169.1, 315/169.4; 313/484, 491, 514, 582; 348/671
See application file for complete search history.

(56) References Cited

U.S. PATENT DOCUMENTS 6,097,358 A * 8/2000 Hirakawa et al. ..... 345/63
7,187,348 B2 * 3/2007 Iwami et al. ..... 345/62

FOREIGN PATENT DOCUMENTS

| | | | |
|---|---|---|---|
| EP | 1 494 198 | A2 | 6/2004 |
| EP | 1 496 493 | A2 | 6/2004 |
| EP | 1 450 337 | A2 | 8/2004 |
| EP | 1 492 075 | A2 | 12/2004 |
| EP | 1 494 199 | A2 | 1/2005 |
| JP | 2000-227778 | A | 8/2000 |

OTHER PUBLICATIONS

European Office Action dated Feb. 19, 2008 issued in EP Application No. 05014540.8.

* cited by examiner

*Primary Examiner*—Abbas I Abdulselam
(74) *Attorney, Agent, or Firm*—Sughrue Mion, PLLC

(57) ABSTRACT

A method of driving a display panel for displaying a quality image reduced of display noise. A first process is executed for making the sub-field different between display lines adjacent in the number of M, in order for causing the state of the pixel cells to transfer from the one state into the other state of on and off modes, in a particular sub-field group having sub-fields in number of M (M: integer of 2 or greater) arranged successive within the frame display period and in a subsequent sub-field group of among sub-field groups subsequent to the particular sub-field group. Within the particular sub-field group, executed is any one of a second process for causing a state of the pixel cells from the one state into the other state only within a predetermined one of the sub-fields of the particular sub-field group and the first process.

16 Claims, 23 Drawing Sheets

FIG. 2

[ SELECTIVE ERASURE ]

| Ds | HD 1 | 2 | 3 | 4 | 5 | 6 | 7 | 8 | 9 | 10 | 11 | 12 | 13 | 14 | DRIVING STATE IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | EMISSION LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

FIG. 4B

| | (4N)-TH COLUMN | (4N - 1)-TH COLUMN | (4N - 2)-TH COLUMN | (4N - 3)-TH COLUMN |
|---|---|---|---|---|
| (4N - 3)-TH DISPLAY LINE | 7 | 6 | 5 | 4 |
| (4N - 2)-TH DISPLAY LINE | 7 | 6 | 5 | 4 |
| (4N - 1)-TH DISPLAY LINE | 7 | 6 | 5 | 4 |
| (4N)-TH DISPLAY LINE | 7 | 6 | 5 | 4 |

FIG. 4A

| | (4N)-TH COLUMN | (4N - 1)-TH COLUMN | (4N - 2)-TH COLUMN | (4N - 3)-TH COLUMN |
|---|---|---|---|---|
| (4N - 3)-TH DISPLAY LINE | 3 | 2 | 1 | 0 |
| (4N - 2)-TH DISPLAY LINE | 3 | 2 | 1 | 0 |
| (4N - 1)-TH DISPLAY LINE | 3 | 2 | 1 | 0 |
| (4N)-TH DISPLAY LINE | 3 | 2 | 1 | 0 |

FIG. 5

DISPLAY LINE

| | CONVERSION TABLE | | | SF 0 | SF 1 | SF 21 | SF 22 | SF 23 | SF 24 | SF 31 | SF 32 | SF 33 | SF 34 | SF 41 | SF 42 | SF 43 | SF 44 |
|---|---|---|---|---|---|---|---|---|---|---|---|---|---|---|---|---|---|
| | KD | GD | | | | | | | | | | | | | | | |
| WITH NO LINE DITHERING | 000 | 10000000000000 | 4N | ● | | | | | | | | | | | | | |
| | | | 4N-1 | ● | | | | | | | | | | | | | |
| | | | 4N-2 | ● | | | | | | | | | | | | | |
| | | | 4N-3 | ● | | | | | | | | | | | | | |
| | 001 | 01000000000000 | 4N | | ○● | | | | | | | | | | | | |
| | | | 4N-1 | | ○● | | | | | | | | | | | | |
| | | | 4N-2 | | ○● | | | | | | | | | | | | |
| | | | 4N-3 | | ○● | | | | | | | | | | | | |
| | 010 | 00000100000000 | 4N | | ○ | ○ | ○ | ○ | ○● | | | | | | | | |
| | | | 4N-1 | | ○ | ○ | ○ | ○ | ○● | | | | | | | | |
| | | | 4N-2 | | ○ | ○ | ○ | ○ | ○● | | | | | | | | |
| | | | 4N-3 | | ○ | ○ | ○ | ○ | ○● | | | | | | | | |
| WITH LINE DITHERING | 011 | 00100000000000 | 4N | | ○ | ○● | | | | | | | | | | | |
| | | 00010000000000 | 4N-1 | | ○ | ○ | ○● | | | | | | | | | | |
| | | 00001000000000 | 4N-2 | | ○ | ○ | ○ | ○● | | | | | | | | | |
| | | 00000100000000 | 4N-3 | | ○ | ○ | ○ | ○ | ○● | | | | | | | | |
| | 100 | 00000010000000 | 4N | | ○ | ○ | ○ | ○ | ○ | ○● | | | | | | | |
| | | 00000001000000 | 4N-1 | | ○ | ○ | ○ | ○ | ○ | ○ | ○● | | | | | | |
| | | 00000000100000 | 4N-2 | | ○ | ○ | ○ | ○ | ○ | ○ | ○ | ○● | | | | | |
| | | 00000000010000 | 4N-3 | | ○ | ○ | ○ | ○ | ○ | ○ | ○ | ○ | ○● | | | | |
| | 101 | 00000000001000 | 4N | | ○ | ○ | ○ | ○ | ○ | ○ | ○ | ○ | ○ | ○● | | | |
| | | 00000000000100 | 4N-1 | | ○ | ○ | ○ | ○ | ○ | ○ | ○ | ○ | ○ | ○ | ○● | | |
| | | 00000000000010 | 4N-2 | | ○ | ○ | ○ | ○ | ○ | ○ | ○ | ○ | ○ | ○ | ○ | ○● | |
| | | 00000000000001 | 4N-3 | | ○ | ○ | ○ | ○ | ○ | ○ | ○ | ○ | ○ | ○ | ○ | ○ | ○● |

FIG. 7

| PD | DITHER-ADDED PIXEL DATA | | | | SF 0 | SF 1 | SF 21 | SF 22 | SF 23 | SF 24 | SF 31 | SF 32 | SF 33 | SF 34 | SF 41 | SF 42 | SF 43 | SF 44 | VISUAL LUMINANCE |
|---|---|---|---|---|---|---|---|---|---|---|---|---|---|---|---|---|---|---|---|
| | $KD_{(1,1)}$ | $KD_{(1,2)}$ | $KD_{(1,3)}$ | $KD_{(1,4)}$ | | | | | | | | | | | | | | | |
| 0 | 000 | 000 | 000 | 000 | | | | | | | | | | | | | | | 0 |
| 1 | 000 | 000 | 000 | 001 | | 1 | | | | | | | | | | | | | 1 |
| 2 | 000 | 000 | 001 | 001 | | 2 | | | | | | | | | | | | | 2 |
| 3 | 000 | 001 | 001 | 001 | | 3 | | | | | | | | | | | | | 3 |
| 4 | 001 | 001 | 001 | 001 | | 4 | | | | | | | | | | | | | 4 |
| 5 | 001 | 001 | 001 | 010 | | 4 | 0.5 | 0.5 | 0.5 | 0.5 | | | | | | | | | 6 |
| 6 | 001 | 001 | 010 | 010 | | 4 | 1 | 1 | 1 | 1 | | | | | | | | | 8 |
| 7 | 001 | 010 | 010 | 010 | | 4 | 1.5 | 1.5 | 1.5 | 1.5 | | | | | | | | | 10 |
| 8 | 010 | 010 | 010 | 010 | | 4 | 2 | 2 | 2 | 2 | | | | | | | | | 12 |
| 9 | 011 | 011 | 011 | 100 | | 4 | 2 | 2 | 2 | 2 | 0.75 | 0.75 | 0.75 | 0.75 | | | | | 15 |
| 10 | 011 | 011 | 100 | 100 | | 4 | 2 | 2 | 2 | 2 | 1.5 | 1.5 | 1.5 | 1.5 | | | | | 18 |
| 11 | 011 | 100 | 100 | 100 | | 4 | 2 | 2 | 2 | 2 | 2.25 | 2.25 | 2.25 | 2.25 | | | | | 21 |
| 12 | 100 | 100 | 100 | 100 | | 4 | 2 | 2 | 2 | 2 | 3 | 3 | 3 | 3 | | | | | 24 |

FIG. 8

| PD | DITHER-ADDED PIXEL DATA | | | | SF 0 | SF 1 | SF 21 | SF 22 | SF 23 | SF 24 | SF 31 | SF 32 | SF 33 | SF 34 | SF 41 | SF 42 | SF 43 | SF 44 | VISUAL LUMINANCE |
|---|---|---|---|---|---|---|---|---|---|---|---|---|---|---|---|---|---|---|---|
| | $KD_{(2,1)}$ | $KD_{(2,2)}$ | $KD_{(2,3)}$ | $KD_{(2,4)}$ | | | | | | | | | | | | | | | |
| 0 | 000 | 000 | 000 | 000 | | | | | | | | | | | | | | | 0 |
| 1 | 000 | 000 | 000 | 001 | | 1 | | | | | | | | | | | | | 1 |
| 2 | 000 | 000 | 001 | 001 | | 2 | | | | | | | | | | | | | 2 |
| 3 | 000 | 001 | 001 | 001 | | 3 | | | | | | | | | | | | | 3 |
| 4 | 001 | 001 | 001 | 001 | | 4 | | | | | | | | | | | | | 4 |
| 5 | 001 | 001 | 001 | 010 | | 4 | 0.5 | 0.5 | 0.5 | 0.5 | | | | | | | | | 6 |
| 6 | 001 | 001 | 010 | 010 | | 4 | 1 | 1 | 1 | 1 | | | | | | | | | 8 |
| 7 | 001 | 010 | 010 | 010 | | 4 | 1.5 | 1.5 | 1.5 | 1.5 | | | | | | | | | 10 |
| 8 | 010 | 010 | 010 | 010 | | 4 | 2 | 2 | 2 | 2 | | | | | | | | | 12 |
| 9 | 011 | 011 | 100 | 100 | | 4 | 2 | 2 | 2 | 1 | 1.5 | 1.5 | 1.5 | | | | | | 15.5 |
| 10 | 011 | 100 | 100 | 100 | | 4 | 2 | 2 | 2 | 1.5 | 2.25 | 2.25 | 2.25 | | | | | | 18.25 |
| 11 | 100 | 100 | 100 | 100 | | 4 | 2 | 2 | 2 | 2 | 3 | 3 | 3 | | | | | | 21 |
| 12 | 100 | 100 | 100 | 101 | | 4 | 2 | 2 | 2 | 2 | 3 | 3 | 3 | 0.75 | 1 | 1 | 1 | | 24.75 |

FIG. 9

| PD | DITHER-ADDED PIXEL DATA | | | | SF 0 | SF 1 | SF 21 | SF 22 | SF 23 | SF 24 | SF 31 | SF 32 | SF 33 | SF 34 | SF 41 | SF 42 | SF 43 | SF 44 | VISUAL LUMINANCE |
|---|---|---|---|---|---|---|---|---|---|---|---|---|---|---|---|---|---|---|---|
| | KD (3,1) | KD (3,2) | KD (3,3) | KD (3,4) | | | | | | | | | | | | | | | |
| 0 | 000 | 000 | 000 | 000 | | | | | | | | | | | | | | | 0 |
| 1 | 000 | 000 | 000 | 001 | | 1 | | | | | | | | | | | | | 1 |
| 2 | 000 | 000 | 001 | 001 | | 2 | | | | | | | | | | | | | 2 |
| 3 | 000 | 001 | 001 | 001 | | 3 | | | | | | | | | | | | | 3 |
| 4 | 001 | 001 | 001 | 001 | | 4 | | | | | | | | | | | | | 4 |
| 5 | 001 | 001 | 001 | 010 | | 4 | 0.5 | 0.5 | 0.5 | 0.5 | | | | | | | | | 6 |
| 6 | 001 | 001 | 010 | 010 | | 4 | 1 | 1 | 1 | 1 | | | | | | | | | 8 |
| 7 | 001 | 010 | 010 | 010 | | 4 | 1.5 | 1.5 | 1.5 | 1.5 | | | | | | | | | 10 |
| 8 | 010 | 010 | 010 | 010 | | 4 | 2 | 2 | 2 | 2 | | | | | | | | | 12 |
| 9 | 011 | 100 | 100 | 100 | | 4 | 2 | 2 | 1.5 | 1.5 | 2.25 | 2.25 | | | | | | | 15.5 |
| 10 | 100 | 100 | 100 | 100 | | 4 | 2 | 2 | 2 | 2 | 3 | 3 | | | | | | | 18 |
| 11 | 100 | 100 | 100 | 101 | | 4 | 2 | 2 | 2 | 2 | 3 | 3 | 0.75 | 0.75 | 1 | 1 | | | 21.5 |
| 12 | 100 | 100 | 101 | 101 | | 4 | 2 | 2 | 2 | 2 | 3 | 3 | 1.5 | 1.5 | 2 | 2 | | | 25 |

FIG. 10

| PD | DITHER-ADDED PIXEL DATA | | | | SF 0 | SF 1 | SF 21 | SF 22 | SF 23 | SF 24 | SF 31 | SF 32 | SF 33 | SF 34 | SF 41 | SF 42 | SF 43 | SF 44 | VISUAL LUMINANCE |
|---|---|---|---|---|---|---|---|---|---|---|---|---|---|---|---|---|---|---|---|
| | KD(4,1) | KD(4,2) | KD(4,3) | KD(4,4) | | | | | | | | | | | | | | | |
| 0 | 000 | 000 | 000 | 000 | | | | | | | | | | | | | | | 0 |
| 1 | 000 | 000 | 000 | 001 | | 1 | | | | | | | | | | | | | 1 |
| 2 | 000 | 000 | 001 | 001 | | 2 | | | | | | | | | | | | | 2 |
| 3 | 000 | 001 | 001 | 001 | | 3 | | | | | | | | | | | | | 3 |
| 4 | 001 | 001 | 001 | 001 | | 4 | | | | | | | | | | | | | 4 |
| 5 | 001 | 001 | 001 | 010 | | 4 | 0.5 | 0.5 | 0.5 | 0.5 | | | | | | | | | 6 |
| 6 | 001 | 001 | 010 | 010 | | 4 | 1 | 1 | 1 | 1 | | | | | | | | | 8 |
| 7 | 001 | 010 | 010 | 010 | | 4 | 1.5 | 1.5 | 1.5 | 1.5 | | | | | | | | | 10 |
| 8 | 010 | 010 | 010 | 010 | | 4 | 2 | 2 | 2 | 2 | | | | | | | | | 12 |
| 9 | 100 | 100 | 100 | 100 | | 4 | 2 | 2 | 2 | 2 | 3 | | | | | | | | 15 |
| 10 | 100 | 100 | 100 | 101 | | 4 | 2 | 2 | 2 | 2 | 3 | 0.75 | 0.75 | 0.75 | 1 | | | | 18.25 |
| 11 | 100 | 100 | 101 | 101 | | 4 | 2 | 2 | 2 | 2 | 3 | 1.5 | 1.5 | 1.5 | 2 | | | | 21.5 |
| 12 | 100 | 101 | 101 | 101 | | 4 | 2 | 2 | 2 | 2 | 3 | 2.25 | 2.25 | 2.25 | 3 | | | | 24.75 |

FIG. 14

WITH NO LINE DITHERING

WITH LINE DITHERING

| CONVERSION TABLE KD | GD | DISPLAY LINE | SF 0 | SF 1 | SF 21 | SF 22 | SF 23 | SF 24 | SF 31 | SF 32 | SF 33 | SF 34 | SF 41 | SF 42 | SF 43 | SF 44 | SF 51 | SF 52 | SF 53 | SF 54 | LUMINANCE |
|---|---|---|---|---|---|---|---|---|---|---|---|---|---|---|---|---|---|---|---|---|---|
| 000 | 100000000000000000 | 4N | ● | | | | | | | | | | | | | | | | | | 0 |
| | | 4N-1 | ● | | | | | | | | | | | | | | | | | | |
| | | 4N-2 | ● | | | | | | | | | | | | | | | | | | |
| | | 4N-3 | ● | | | | | | | | | | | | | | | | | | |
| 001 | 010000000000000000 | 4N | | ○● | | | | | | | | | | | | | | | | | 4 |
| | | 4N-1 | | ○● | | | | | | | | | | | | | | | | | |
| | | 4N-2 | | ○● | | | | | | | | | | | | | | | | | |
| | | 4N-3 | | ○● | | | | | | | | | | | | | | | | | |
| 010 | 000001000000000000 | 4N | | ○ | ○ | ○ | ○ | ○● | | | | | | | | | | | | | 12 |
| | | 4N-1 | | ○ | ○ | ○ | ○ | ○● | | | | | | | | | | | | | |
| | | 4N-2 | | ○ | ○ | ○ | ○ | ○● | | | | | | | | | | | | | |
| | | 4N-3 | | ○ | ○ | ○ | ○ | ○● | | | | | | | | | | | | | |
| 011 | 001000000000000000 | 4N | | ○ | ○● | | | | | | | | | | | | | | | | 6 |
| | 000100000000000000 | 4N-1 | | ○ | ○ | ○● | | | | | | | | | | | | | | | 8 |
| | 000010000000000000 | 4N-2 | | ○ | ○ | ○ | ○● | | | | | | | | | | | | | | 10 |
| | 000001000000000000 | 4N-3 | | ○ | ○ | ○ | ○ | ○● | | | | | | | | | | | | | 12 |
| 100 | 000000100000000000 | 4N | | ○ | ○ | ○ | ○ | ○ | ○● | | | | | | | | | | | | 15 |
| | 000000010000000000 | 4N-1 | | ○ | ○ | ○ | ○ | ○ | ○ | ○● | | | | | | | | | | | 18 |
| | 000000001000000000 | 4N-2 | | ○ | ○ | ○ | ○ | ○ | ○ | ○ | ○● | | | | | | | | | | 21 |
| | 000000000100000000 | 4N-3 | | ○ | ○ | ○ | ○ | ○ | ○ | ○ | ○ | ○● | | | | | | | | | 24 |
| 101 | 000000000010000000 | 4N | | ○ | ○ | ○ | ○ | ○ | ○ | ○ | ○ | ○ | ○● | | | | | | | | 28 |
| | 000000000001000000 | 4N-1 | | ○ | ○ | ○ | ○ | ○ | ○ | ○ | ○ | ○ | ○ | ○● | | | | | | | 32 |
| | 000000000000100000 | 4N-2 | | ○ | ○ | ○ | ○ | ○ | ○ | ○ | ○ | ○ | ○ | ○ | ○● | | | | | | 36 |
| | 000000000000010000 | 4N-3 | | ○ | ○ | ○ | ○ | ○ | ○ | ○ | ○ | ○ | ○ | ○ | ○ | ○● | | | | | 40 |
| 110 | 000000000000001000 | 4N | | ○ | ○ | ○ | ○ | ○ | ○ | ○ | ○ | ○ | ○ | ○ | ○ | ○ | ○● | | | | 45 |
| | 000000000000000100 | 4N-1 | | ○ | ○ | ○ | ○ | ○ | ○ | ○ | ○ | ○ | ○ | ○ | ○ | ○ | ○ | ○● | | | 50 |
| | 000000000000000010 | 4N-2 | | ○ | ○ | ○ | ○ | ○ | ○ | ○ | ○ | ○ | ○ | ○ | ○ | ○ | ○ | ○ | ○● | | 55 |
| | 000000000000000001 | 4N-3 | | ○ | ○ | ○ | ○ | ○ | ○ | ○ | ○ | ○ | ○ | ○ | ○ | ○ | ○ | ○ | ○ | ○● | 60 |

●: TRANSITION TO ERASE MODE ○: SUSTAIN-DISCHARGE EMISSION

FIG. 15

| PD | DITHER-ADDED PIXEL DATA | | | | SF 0 | SF 1 | SG2 | | | | SG3 | | | | SG4 | | | | SG5 | | | | LUMINANCE |
|---|---|---|---|---|---|---|---|---|---|---|---|---|---|---|---|---|---|---|---|---|---|---|---|
| | $KD_{(1,1)}$ | $KD_{(1,2)}$ | $KD_{(1,3)}$ | $KD_{(1,4)}$ | | | SF 21 | SF 22 | SF 23 | SF 24 | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | | | | 0 |
| 1 | 000 | 000 | 000 | 001 | | 1 | | | | | | | | | | | | | | | | | 1 |
| 2 | 000 | 000 | 001 | 001 | | 2 | | | | | | | | | | | | | | | | | 2 |
| 3 | 000 | 001 | 001 | 001 | | 3 | | | | | | | | | | | | | | | | | 3 |
| 4 | 001 | 001 | 001 | 001 | | 4 | | | | | | | | | | | | | | | | | 4 |
| 5 | 001 | 001 | 001 | 010 | | 4 | 0.5 | 0.5 | 0.5 | 0.5 | | | | | | | | | | | | | 6 |
| 6 | 001 | 001 | 010 | 010 | | 4 | 1 | 1 | 1 | 1 | | | | | | | | | | | | | 8 |
| 7 | 001 | 010 | 010 | 010 | | 4 | 1.5 | 1.5 | 1.5 | 1.5 | | | | | | | | | | | | | 10 |
| 8 | 010 | 010 | 010 | 010 | | 4 | 2 | 2 | 2 | 2 | | | | | | | | | | | | | 12 |
| 9 | 011 | 011 | 011 | 100 | | 4 | 2 | 2 | 2 | 2 | 0.75 | 0.75 | 0.75 | 0.75 | | | | | | | | | 15 |
| 10 | 011 | 011 | 100 | 100 | | 4 | 2 | 2 | 2 | 2 | 1.5 | 1.5 | 1.5 | 1.5 | | | | | | | | | 18 |
| 11 | 011 | 100 | 100 | 100 | | 4 | 2 | 2 | 2 | 2 | 2.25 | 2.25 | 2.25 | 2.25 | | | | | | | | | 21 |
| 12 | 100 | 100 | 100 | 100 | | 4 | 2 | 2 | 2 | 2 | 3 | 3 | 3 | 3 | | | | | | | | | 24 |
| 13 | 100 | 100 | 100 | 101 | | 4 | 2 | 2 | 2 | 2 | 3 | 3 | 3 | 3 | 1 | 1 | 1 | 1 | | | | | 28 |
| 14 | 100 | 100 | 101 | 101 | | 4 | 2 | 2 | 2 | 2 | 3 | 3 | 3 | 3 | 2 | 2 | 2 | 2 | | | | | 32 |
| 15 | 100 | 101 | 101 | 101 | | 4 | 2 | 2 | 2 | 2 | 3 | 3 | 3 | 3 | 3 | 3 | 3 | 3 | | | | | 36 |
| 16 | 101 | 101 | 101 | 101 | | 4 | 2 | 2 | 2 | 2 | 3 | 3 | 3 | 3 | 4 | 4 | 4 | 4 | | | | | 40 |

FIG. 16

| PD | DITHER-ADDED PIXEL DATA | | | | SF 0 | SF 1 | SG2 | | | | SG3 | | | | SG4 | | | | SG5 | | | | LUMINANCE |
|---|---|---|---|---|---|---|---|---|---|---|---|---|---|---|---|---|---|---|---|---|---|---|---|
| | $KD_{(2,1)}$ | $KD_{(2,2)}$ | $KD_{(2,3)}$ | $KD_{(2,4)}$ | | | SF 21 | SF 22 | SF 23 | SF 24 | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | | | | 0 |
| 1 | 000 | 000 | 000 | 001 | | 1 | | | | | | | | | | | | | | | | | 1 |
| 2 | 000 | 000 | 001 | 001 | | 2 | | | | | | | | | | | | | | | | | 2 |
| 3 | 000 | 001 | 001 | 001 | | 3 | | | | | | | | | | | | | | | | | 3 |
| 4 | 001 | 001 | 001 | 001 | | 4 | | | | | | | | | | | | | | | | | 4 |
| 5 | 001 | 001 | 001 | 010 | | 4 | 0.5 | 0.5 | 0.5 | 0.5 | | | | | | | | | | | | | 6 |
| 6 | 001 | 001 | 010 | 010 | | 4 | 1 | 1 | 1 | 1 | | | | | | | | | | | | | 8 |
| 7 | 001 | 010 | 010 | 010 | | 4 | 1.5 | 1.5 | 1.5 | 1.5 | | | | | | | | | | | | | 10 |
| 8 | 010 | 010 | 010 | 010 | | 4 | 2 | 2 | 2 | 2 | | | | | | | | | | | | | 12 |
| 9 | 011 | 011 | 011 | 100 | | 4 | 2 | 2 | 2 | 1 | 1.5 | 1.5 | 1.5 | | | | | | | | | | 16 |
| 10 | 011 | 011 | 100 | 100 | | 4 | 2 | 2 | 2 | 1.5 | 2.25 | 2.25 | 2.25 | | | | | | | | | | 18 |
| 11 | 011 | 100 | 100 | 100 | | 4 | 2 | 2 | 2 | 2 | 3 | 3 | 3 | | | | | | | | | | 21 |
| 12 | 100 | 100 | 100 | 100 | | 4 | 2 | 2 | 2 | 2 | 3 | 3 | 3 | 0.75 | 1 | 1 | 1 | | | | | | 25 |
| 13 | 100 | 100 | 100 | 101 | | 4 | 2 | 2 | 2 | 2 | 3 | 3 | 3 | 1.5 | 2 | 2 | 2 | | | | | | 28 |
| 14 | 100 | 100 | 101 | 101 | | 4 | 2 | 2 | 2 | 2 | 3 | 3 | 3 | 2.25 | 3 | 3 | 3 | | | | | | 32 |
| 15 | 100 | 101 | 101 | 101 | | 4 | 2 | 2 | 2 | 2 | 3 | 3 | 3 | 3 | 4 | 4 | 4 | | | | | | 36 |
| 16 | 101 | 101 | 101 | 101 | | 4 | 2 | 2 | 2 | 2 | 3 | 3 | 3 | 3 | 4 | 4 | 4 | 1 | 1.25 | 1.25 | 1.25 | | 41 |

FIG. 17

| PD | DITHER-ADDED PIXEL DATA | | | | SF 0 | SF 1 | SG2 | | | | SG3 | | | | SG4 | | | | SG5 | | | | LUMINANCE |
|---|---|---|---|---|---|---|---|---|---|---|---|---|---|---|---|---|---|---|---|---|---|---|---|
| | $KD_{(3,1)}$ | $KD_{(3,2)}$ | $KD_{(3,3)}$ | $KD_{(3,4)}$ | | | SF 21 | SF 22 | SF 23 | SF 24 | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | | | | 0 |
| 1 | 000 | 000 | 000 | 001 | | 1 | | | | | | | | | | | | | | | | | 1 |
| 2 | 000 | 000 | 001 | 001 | | 2 | | | | | | | | | | | | | | | | | 2 |
| 3 | 000 | 001 | 001 | 001 | | 3 | | | | | | | | | | | | | | | | | 3 |
| 4 | 001 | 001 | 001 | 001 | | 4 | | | | | | | | | | | | | | | | | 4 |
| 5 | 001 | 001 | 001 | 010 | | 4 | 0.5 | 0.5 | 0.5 | 0.5 | | | | | | | | | | | | | 6 |
| 6 | 001 | 001 | 010 | 010 | | 4 | 1 | 1 | 1 | 1 | | | | | | | | | | | | | 8 |
| 7 | 001 | 010 | 010 | 010 | | 4 | 1.5 | 1.5 | 1.5 | 1.5 | | | | | | | | | | | | | 10 |
| 8 | 010 | 010 | 010 | 010 | | 4 | 2 | 2 | 2 | 2 | | | | | | | | | | | | | 12 |
| 9 | 011 | 011 | 011 | 100 | | 4 | 2 | 2 | 1.5 | 1.5 | 2.25 | 2.25 | | | | | | | | | | | 16 |
| 10 | 011 | 011 | 100 | 100 | | 4 | 2 | 2 | 2 | 2 | 3 | 3 | | | | | | | | | | | 18 |
| 11 | 011 | 100 | 100 | 100 | | 4 | 2 | 2 | 2 | 2 | 3 | 3 | 0.75 | 0.75 | 1 | 1 | | | | | | | 22 |
| 12 | 100 | 100 | 100 | 100 | | 4 | 2 | 2 | 2 | 2 | 3 | 3 | 1.5 | 1.5 | 2 | 2 | | | | | | | 25 |
| 13 | 100 | 100 | 100 | 101 | | 4 | 2 | 2 | 2 | 2 | 3 | 3 | 2.25 | 2.25 | 3 | 3 | | | | | | | 29 |
| 14 | 100 | 100 | 101 | 101 | | 4 | 2 | 2 | 2 | 2 | 3 | 3 | 3 | 3 | 4 | 4 | | | | | | | 32 |
| 15 | 100 | 101 | 101 | 101 | | 4 | 2 | 2 | 2 | 2 | 3 | 3 | 3 | 3 | 4 | 4 | 1 | 1 | 1.25 | 1.25 | | | 37 |
| 16 | 101 | 101 | 101 | 101 | | 4 | 2 | 2 | 2 | 2 | 3 | 3 | 3 | 3 | 4 | 4 | 2 | 2 | 2.5 | 2.5 | | | 41 |

FIG. 18

| PD | DITHER-ADDED PIXEL DATA | | | | SF 0 | SF 1 | SG2 | | | | SG3 | | | | SG4 | | | | SG5 | | | | LUMINANCE |
|---|---|---|---|---|---|---|---|---|---|---|---|---|---|---|---|---|---|---|---|---|---|---|---|
| | $KD_{(4,1)}$ | $KD_{(4,2)}$ | $KD_{(4,3)}$ | $KD_{(4,4)}$ | | | SF 21 | SF 22 | SF 23 | SF 24 | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | | | | 0 |
| 1 | 000 | 000 | 000 | 001 | | 1 | | | | | | | | | | | | | | | | | 1 |
| 2 | 000 | 000 | 001 | 001 | | 2 | | | | | | | | | | | | | | | | | 2 |
| 3 | 000 | 001 | 001 | 001 | | 3 | | | | | | | | | | | | | | | | | 3 |
| 4 | 001 | 001 | 001 | 001 | | 4 | | | | | | | | | | | | | | | | | 4 |
| 5 | 001 | 001 | 001 | 010 | | 4 | 0.5 | 0.5 | 0.5 | 0.5 | | | | | | | | | | | | | 6 |
| 6 | 001 | 001 | 010 | 010 | | 4 | 1 | 1 | 1 | 1 | | | | | | | | | | | | | 8 |
| 7 | 001 | 010 | 010 | 010 | | 4 | 1.5 | 1.5 | 1.5 | 1.5 | | | | | | | | | | | | | 10 |
| 8 | 010 | 010 | 010 | 010 | | 4 | 2 | 2 | 2 | 2 | | | | | | | | | | | | | 12 |
| 9 | 011 | 011 | 011 | 100 | | 4 | 2 | 2 | 2 | 2 | 3 | | | | | | | | | | | | 15 |
| 10 | 011 | 011 | 100 | 100 | | 4 | 2 | 2 | 2 | 2 | 3 | 0.75 | 0.75 | 0.75 | 1 | | | | | | | | 18 |
| 11 | 011 | 100 | 100 | 100 | | 4 | 2 | 2 | 2 | 2 | 3 | 1.5 | 1.5 | 1.5 | 2 | | | | | | | | 22 |
| 12 | 100 | 100 | 100 | 100 | | 4 | 2 | 2 | 2 | 2 | 3 | 2.25 | 2.25 | 2.25 | 3 | | | | | | | | 25 |
| 13 | 100 | 100 | 100 | 101 | | 4 | 2 | 2 | 2 | 2 | 3 | 3 | 3 | 3 | 4 | | | | | | | | 28 |
| 14 | 100 | 100 | 101 | 101 | | 4 | 2 | 2 | 2 | 2 | 3 | 3 | 3 | 3 | 4 | 1 | 1 | 1 | 1.25 | | | | 32 |
| 15 | 100 | 101 | 101 | 101 | | 4 | 2 | 2 | 2 | 2 | 3 | 3 | 3 | 3 | 4 | 2 | 2 | 2 | 2.5 | | | | 37 |
| 16 | 101 | 101 | 101 | 101 | | 4 | 2 | 2 | 2 | 2 | 3 | 3 | 3 | 3 | 4 | 3 | 3 | 3 | 3.75 | | | | 41 |

FIG. 19

| | CONVERSION TABLE KD | CONVERSION TABLE GD | DISPLAY LINE | SF 0 | SF 1 | SF 2 | SF 31 | SF 32 | SF 33 | SF 34 | SF 41 | SF 42 | SF 43 | SF 44 | SF 51 | SF 52 | SF 53 | SF 54 | LUMINANCE |
|---|---|---|---|---|---|---|---|---|---|---|---|---|---|---|---|---|---|---|---|
| WITH NO LINE DITHERING | 000 | 100000000000000 | 4N | ● | | | | | | | | | | | | | | | 0 |
| | | | 4N-1 | ● | | | | | | | | | | | | | | | |
| | | | 4N-2 | ● | | | | | | | | | | | | | | | |
| | | | 4N-3 | ● | | | | | | | | | | | | | | | |
| | 001 | 010000000000000 | 4N | | ○● | | | | | | | | | | | | | | 4 |
| | | | 4N-1 | | ○● | | | | | | | | | | | | | | |
| | | | 4N-2 | | ○● | | | | | | | | | | | | | | |
| | | | 4N-3 | | ○● | | | | | | | | | | | | | | |
| | 010 | 001000000000000 | 4N | | ○ | ○● | | | | | | | | | | | | | 12 |
| | | | 4N-1 | | ○ | ○● | | | | | | | | | | | | | |
| | | | 4N-2 | | ○ | ○● | | | | | | | | | | | | | |
| | | | 4N-3 | | ○ | ○● | | | | | | | | | | | | | |
| WITH LINE DITHERING | 011 | 000000100000000 | 4N | | ○ | ○ | ○ | ○ | ○ | ○● | | | | | | | | | 24 |
| | | | 4N-1 | | ○ | ○ | ○ | ○ | ○ | ○● | | | | | | | | | |
| | | | 4N-2 | | ○ | ○ | ○ | ○ | ○ | ○● | | | | | | | | | |
| | | | 4N-3 | | ○ | ○ | ○ | ○ | ○ | ○● | | | | | | | | | |
| | 100 | 000000100000000 | 4N | | ○ | ○ | ○● | | | | | | | | | | | | 15 |
| | | 000000010000000 | 4N-1 | | ○ | ○ | ○ | ○● | | | | | | | | | | | 18 |
| | | 000000001000000 | 4N-2 | | ○ | ○ | ○ | ○ | ○● | | | | | | | | | | 21 |
| | | 000000000100000 | 4N-3 | | ○ | ○ | ○ | ○ | ○ | ○● | | | | | | | | | 24 |
| | 101 | 000000010000000 | 4N | | ○ | ○ | ○ | ○ | ○ | ○ | ○● | | | | | | | | 28 |
| | | 000000001000000 | 4N-1 | | ○ | ○ | ○ | ○ | ○ | ○ | ○ | ○● | | | | | | | 32 |
| | | 000000000100000 | 4N-2 | | ○ | ○ | ○ | ○ | ○ | ○ | ○ | ○ | ○● | | | | | | 36 |
| | | 000000000010000 | 4N-3 | | ○ | ○ | ○ | ○ | ○ | ○ | ○ | ○ | ○ | ○● | | | | | 40 |
| | 110 | 000000000001000 | 4N | | ○ | ○ | ○ | ○ | ○ | ○ | ○ | ○ | ○ | ○ | ○● | | | | 45 |
| | | 000000000000100 | 4N-1 | | ○ | ○ | ○ | ○ | ○ | ○ | ○ | ○ | ○ | ○ | ○ | ○● | | | 50 |
| | | 000000000000010 | 4N-2 | | ○ | ○ | ○ | ○ | ○ | ○ | ○ | ○ | ○ | ○ | ○ | ○ | ○● | | 55 |
| | | 000000000000001 | 4N-3 | | ○ | ○ | ○ | ○ | ○ | ○ | ○ | ○ | ○ | ○ | ○ | ○ | ○ | ○● | 60 |

●: TRANSITION TO ERASE MODE ○: SUSTAIN-DISCHARGE EMISSION

FIG. 20

| PD | DITHER-ADDED PIXEL DATA | | | | SF 0 | SF 1 | SF 2 | SG3 | | | | SG4 | | | | SG5 | | | | LUMINANCE |
|---|---|---|---|---|---|---|---|---|---|---|---|---|---|---|---|---|---|---|---|---|
| | $KD_{(1,1)}$ | $KD_{(1,2)}$ | $KD_{(1,3)}$ | $KD_{(1,4)}$ | | | | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | 0 |
| 1 | 000 | 000 | 000 | 001 | | 1 | | | | | | | | | | | | | | 1 |
| 2 | 000 | 000 | 001 | 001 | | 2 | | | | | | | | | | | | | | 2 |
| 3 | 000 | 001 | 001 | 001 | | 3 | | | | | | | | | | | | | | 3 |
| 4 | 001 | 001 | 001 | 001 | | 4 | | | | | | | | | | | | | | 4 |
| 5 | 001 | 001 | 001 | 010 | | 4 | 0.5 | | | | | | | | | | | | | 6 |
| 6 | 001 | 001 | 010 | 010 | | 4 | 1 | | | | | | | | | | | | | 8 |
| 7 | 001 | 010 | 010 | 010 | | 4 | 1.5 | | | | | | | | | | | | | 10 |
| 8 | 010 | 010 | 010 | 010 | | 4 | 2 | | | | | | | | | | | | | 12 |
| 9 | 011 | 011 | 011 | 100 | | 4 | 2 | 0.75 | 0.75 | 0.75 | 0.75 | | | | | | | | | 15 |
| 10 | 011 | 011 | 100 | 100 | | 4 | 2 | 1.5 | 1.5 | 1.5 | 1.5 | | | | | | | | | 18 |
| 11 | 011 | 100 | 100 | 100 | | 4 | 2 | 2.25 | 2.25 | 2.25 | 2.25 | | | | | | | | | 21 |
| 12 | 100 | 100 | 100 | 100 | | 4 | 2 | 3 | 3 | 3 | 3 | | | | | | | | | 24 |
| 13 | 100 | 100 | 100 | 101 | | 4 | 2 | 3 | 3 | 3 | 3 | 1 | 1 | 1 | 1 | | | | | 28 |
| 14 | 100 | 100 | 101 | 101 | | 4 | 2 | 3 | 3 | 3 | 3 | 2 | 2 | 2 | 2 | | | | | 32 |
| 15 | 100 | 101 | 101 | 101 | | 4 | 2 | 3 | 3 | 3 | 3 | 3 | 3 | 3 | 3 | | | | | 36 |
| 16 | 101 | 101 | 101 | 101 | | 4 | 2 | 3 | 3 | 3 | 3 | 4 | 4 | 4 | 4 | | | | | 40 |

FIG. 21

| PD | DITHER-ADDED PIXEL DATA | | | | SF 0 | SF 1 | SF 2 | SG3 | | | | SG4 | | | | SG5 | | | | LUMINANCE |
|---|---|---|---|---|---|---|---|---|---|---|---|---|---|---|---|---|---|---|---|---|
| | $KD_{(2,1)}$ | $KD_{(2,2)}$ | $KD_{(2,3)}$ | $KD_{(2,4)}$ | | | | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | 0 |
| 1 | 000 | 000 | 000 | 001 | | 1 | | | | | | | | | | | | | | 1 |
| 2 | 000 | 000 | 001 | 001 | | 2 | | | | | | | | | | | | | | 2 |
| 3 | 000 | 001 | 001 | 001 | | 3 | | | | | | | | | | | | | | 3 |
| 4 | 001 | 001 | 001 | 001 | | 4 | | | | | | | | | | | | | | 4 |
| 5 | 001 | 001 | 001 | 010 | | 4 | 0.5 | | | | | | | | | | | | | 6 |
| 6 | 001 | 001 | 010 | 010 | | 4 | 1 | | | | | | | | | | | | | 8 |
| 7 | 001 | 010 | 010 | 010 | | 4 | 1.5 | | | | | | | | | | | | | 10 |
| 8 | 010 | 010 | 010 | 010 | | 4 | 2 | | | | | | | | | | | | | 12 |
| 9 | 011 | 011 | 011 | 100 | | 4 | 2 | 0.75 | 0.75 | 0.75 | 0.75 | | | | | | | | | 15 |
| 10 | 011 | 011 | 100 | 100 | | 4 | 2 | 1.5 | 1.5 | 1.5 | 1.5 | | | | | | | | | 18 |
| 11 | 011 | 100 | 100 | 100 | | 4 | 2 | 2.25 | 2.25 | 2.25 | 2.25 | | | | | | | | | 21 |
| 12 | 100 | 100 | 100 | 100 | | 4 | 2 | 3 | 3 | 3 | 3 | | | | | | | | | 24 |
| 13 | 100 | 100 | 100 | 101 | | 4 | 2 | 3 | 3 | 3 | 1.5 | 2 | 2 | 2 | | | | | | 29 |
| 14 | 100 | 100 | 101 | 101 | | 4 | 2 | 3 | 3 | 3 | 2.25 | 3 | 3 | 3 | | | | | | 32 |
| 15 | 100 | 101 | 101 | 101 | | 4 | 2 | 3 | 3 | 3 | 3 | 4 | 4 | 4 | | | | | | 36 |
| 16 | 101 | 101 | 101 | 101 | | 4 | 2 | 3 | 3 | 3 | 3 | 4 | 4 | 4 | 1 | 1.25 | 1.25 | 1.25 | | 41 |

FIG. 22

| PD | DITHER-ADDED PIXEL DATA | | | | SF 0 | SF 1 | SF 2 | SG3 | | | | SG4 | | | | SG5 | | | | LUMINANCE |
|---|---|---|---|---|---|---|---|---|---|---|---|---|---|---|---|---|---|---|---|---|
| | $KD_{(3,1)}$ | $KD_{(3,2)}$ | $KD_{(3,3)}$ | $KD_{(3,4)}$ | | | | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | 0 |
| 1 | 000 | 000 | 000 | 001 | | 1 | | | | | | | | | | | | | | 1 |
| 2 | 000 | 000 | 001 | 001 | | 2 | | | | | | | | | | | | | | 2 |
| 3 | 000 | 001 | 001 | 001 | | 3 | | | | | | | | | | | | | | 3 |
| 4 | 001 | 001 | 001 | 001 | | 4 | | | | | | | | | | | | | | 4 |
| 5 | 001 | 001 | 001 | 010 | | 4 | 0.5 | | | | | | | | | | | | | 6 |
| 6 | 001 | 001 | 010 | 010 | | 4 | 1 | | | | | | | | | | | | | 8 |
| 7 | 001 | 010 | 010 | 010 | | 4 | 1.5 | | | | | | | | | | | | | 10 |
| 8 | 010 | 010 | 010 | 010 | | 4 | 2 | | | | | | | | | | | | | 12 |
| 9 | 011 | 011 | 011 | 100 | | 4 | 2 | 0.75 | 0.75 | 0.75 | 0.75 | | | | | | | | | 15 |
| 10 | 011 | 011 | 100 | 100 | | 4 | 2 | 1.5 | 1.5 | 1.5 | 1.5 | | | | | | | | | 18 |
| 11 | 011 | 100 | 100 | 100 | | 4 | 2 | 2.25 | 2.25 | 2.25 | 2.25 | | | | | | | | | 21 |
| 12 | 100 | 100 | 100 | 100 | | 4 | 2 | 3 | 3 | 3 | 3 | | | | | | | | | 24 |
| 13 | 100 | 100 | 100 | 101 | | 4 | 2 | 3 | 3 | 2.25 | 2.25 | 3 | 3 | | | | | | | 29 |
| 14 | 100 | 100 | 101 | 101 | | 4 | 2 | 3 | 3 | 3 | 3 | 4 | 4 | | | | | | | 32 |
| 15 | 100 | 101 | 101 | 101 | | 4 | 2 | 3 | 3 | 3 | 3 | 4 | 4 | 1 | 1 | 1.25 | 1.25 | | | 37 |
| 16 | 101 | 101 | 101 | 101 | | 4 | 2 | 3 | 3 | 3 | 3 | 4 | 4 | 2 | 2 | 2.5 | 2.5 | | | 41 |

FIG. 23

| PD | DITHER-ADDED PIXEL DATA | | | | SF 0 | SF 1 | SF 2 | SG3 | | | | SG4 | | | | SG5 | | | | LUMINANCE |
|---|---|---|---|---|---|---|---|---|---|---|---|---|---|---|---|---|---|---|---|---|
| | $KD_{(4,1)}$ | $KD_{(4,2)}$ | $KD_{(4,3)}$ | $KD_{(4,4)}$ | | | | SF 31 | SF 32 | SF 33 | SF 34 | SF 41 | SF 42 | SF 43 | SF 44 | SF 51 | SF 52 | SF 53 | SF 54 | |
| 0 | 000 | 000 | 000 | 000 | | | | | | | | | | | | | | | | 0 |
| 1 | 000 | 000 | 000 | 001 | | 1 | | | | | | | | | | | | | | 1 |
| 2 | 000 | 000 | 001 | 001 | | 2 | | | | | | | | | | | | | | 2 |
| 3 | 000 | 001 | 001 | 001 | | 3 | | | | | | | | | | | | | | 3 |
| 4 | 001 | 001 | 001 | 001 | | 4 | | | | | | | | | | | | | | 4 |
| 5 | 001 | 001 | 001 | 010 | | 4 | 0.5 | | | | | | | | | | | | | 6 |
| 6 | 001 | 001 | 010 | 010 | | 4 | 1 | | | | | | | | | | | | | 8 |
| 7 | 001 | 010 | 010 | 010 | | 4 | 1.5 | | | | | | | | | | | | | 10 |
| 8 | 010 | 010 | 010 | 010 | | 4 | 2 | | | | | | | | | | | | | 12 |
| 9 | 011 | 011 | 011 | 100 | | 4 | 2 | 0.75 | 0.75 | 0.75 | 0.75 | | | | | | | | | 15 |
| 10 | 011 | 011 | 100 | 100 | | 4 | 2 | 1.5 | 1.5 | 1.5 | 1.5 | | | | | | | | | 18 |
| 11 | 011 | 100 | 100 | 100 | | 4 | 2 | 2.25 | 2.25 | 2.25 | 2.25 | | | | | | | | | 21 |
| 12 | 100 | 100 | 100 | 100 | | 4 | 2 | 3 | 3 | 3 | 3 | | | | | | | | | 24 |
| 13 | 100 | 100 | 100 | 101 | | 4 | 2 | 3 | 3 | 3 | 3 | 4 | | | | | | | | 28 |
| 14 | 100 | 100 | 101 | 101 | | 4 | 2 | 3 | 3 | 3 | 3 | 4 | 1 | 1 | 1 | 1.25 | | | | 32 |
| 15 | 100 | 101 | 101 | 101 | | 4 | 2 | 3 | 3 | 3 | 3 | 4 | 2 | 2 | 2 | 2.5 | | | | 37 |
| 16 | 101 | 101 | 101 | 101 | | 4 | 2 | 3 | 3 | 3 | 3 | 4 | 3 | 3 | 3 | 3.75 | | | | 41 |

METHOD OF DRIVING A DISPLAY PANEL

BACKGROUND OF THE INVENTION

1. Technical Field

This invention relates to a method of driving a display panel.

2. Description of Related Art

Recently, attentions are drawn to the plasma display panel (hereinafter, referred to as a PDP) having a plurality of discharge cells arranged in a matrix form, as a two-dimensional image display panel. Furthermore, there is known a sub-field technique as a driving method for such a PDP to display an image corresponding to an input video signal. In the sub-field technique, the display period in one field is segmented into a plurality of sub-fields so that discharge emission can take place every sub-field selectively on each discharge cell according to the luminance level as represented by the input video signal. This provides a visual perception at an intermediate luminance corresponding to the total emission period of within the 1-field period.

FIG. 1 shows an example of emission drive sequence based on the sub-field technique. See FIG. 14 of Japanse Patent Kokai No. 2000-227778 (patent document 1), for example.

In the emission drive sequence shown in FIG. 1, one-field period is divided into fourteen sub-field of SF1-SF14. All the PDP discharge cells are initialized to on-mode (Rc) only in the head sub-field SF1 of among those SF1-SF14. Meanwhile, in each sub-field SF1-SF14, the discharge cell is set to off-mode (Wc) according to the input video signal, thereby causing a discharge emission (Ic) only on the on-mode discharge cell over a period assigned to this sub-field.

FIG. 2 shows an example of emission drive patterns of within a 1-field period as to the discharge cell under driven based on the emission drive sequence (see FIG. 28 of patent document 1, for example).

According to the emission patterns shown in FIG. 2, the discharge cell initialized to on-mode in the head sub-field SF1 is set to off-mode in any one of sub-fields SF1-SF14 without having an occasion for return to the on-mode, as shown by the black circles. Accordingly, before set to off-mode, discharge emission takes place on the discharge cell in the successive sub-fields, as shown by the white circles. In this case, because the emissions in 15 patterns shown in FIG. 2 are mutually different in the total emission period within one field period, expression is available with 15 patterns of intermediate intensities. Namely, display can be with (N+1) gray-scale levels (N: the number of sub-fields) of intermediate intensities.

However, in this driving method, there encounters a problem of insufficient levels in gray scale because of the limitation in the number of sub-fields obtainable by dividing one field. For this reason, levels-increasing processing, such as dithering, is performed on the input video signal in order to supplement such insufficient gray-scale levels (see, FIG. 24 of patent document 1, for example).

In dithering, a plurality of pixels adjacent vertically and horizontally of the screen are first taken as one pixel unit, to respectively assign and add dither values, as mutually different coefficient values, to those of pixel data corresponding to the pixels of within the one pixel unit (data representing, with k-bit data, a luminance level represented by the input video signal). Then, the higher-order bit group is extracted out of the dither-added pixel data. In accordance with the higher-order bit group, driving is carried out as to any one of emissions in 15 patterns as shown in FIG. 2. Namely, emission is caused based on the weighting of different intensities provided to the pixels of one pixel unit. This allows for visual perception at the luminance corresponding to the mean luminance over the pixels of within one pixel unit.

Incidentally, it can be considered to apply, together with such dithering, what is called line dithering for emission-driving the pixels belonging to the display lines based on a display line group having a plurality of adjacent display lines by providing the weighting of intensities to the display lines of within the display line group. In such line dithering, the sub-fields for successive discharge emissions are provided different, in the number as shown by the white circles in FIG. 2, between the adjacent ones of display lines. However, because the sub-fields for successively setting the discharge cell to on-mode decrease in the number as the luminance level lowers for expression, line dithering is practically made impossible to carry out. Accordingly, it is not a practice to carry out a line dithering with a gray-scale level for expression at a luminance lower than a predetermined luminance. In this case, the luminance difference between gray-scale levels (with line dithering) for expression with a luminance higher than a predetermined luminance is provided nearly equal over the discharge cells belonging to each of the display lines.

However, the luminance difference differs from display line to display line, between a gray-scale level of expression at a lower luminance than the predetermined luminance (with no line dithering) and a gray-scale level of expression at a higher luminance than that gray-scale level (with line dithering). Accordingly, the luminance difference between gray-scale levels varies between the display lines, thus causing display noise and hence a problem of incurring image deterioration.

SUMMARY OF THE INVENTION

The present invention has been made in order to solve such a problem, and it is an object thereof to provide a method of driving a display panel capable of displaying a quality image reduced of display noise.

A display panel driving method according to a first aspect of the invention is a display panel driving method of gray-level-driving a display panel, having a plurality of pixel cells as pixels arranged on each of display lines, every one of a plurality of sub-fields of a frame display period according to pixel data based on a video signal and corresponding to the pixels, comprising the steps of: causing a state of the pixel cells to transfer from one state into another state of on and off modes only within one of the sub-fields of the frame display period according to the pixel data, to maintain emissions only on the on-mode pixel cells in each of the sub-fields a number of times assigned to the sub-field; wherein executing a first process for making the sub-field different between display lines adjacent in the number of M, in order for causing the state of the pixel cells to transfer from the one state into the other state, in a particular sub-field group having sub-fields in number of M (M: integer of 2 or greater) arranged successive within the frame display period and in a subsequent sub-field group of among sub-field groups subsequent to the particular sub-field group; and executing, within the particular sub-field group, any one of a second process for causing a state of the pixel cells from the one state into the other state only within a predetermined one of the sub-fields of the particular sub-field group and the first process.

BRIEF DESCRIPTION OF THE DRAWINGS

FIG. 2 is a figure showing an example of emission drive pattern of within a 1-field period based on the emission-drive sequence shown in FIG. 1;

FIGS. 4A and 4B are figures showing an example of dither values generated in a dither matrix circuit 220;

FIG. 5 is a figure showing an emission pattern of within a 1-frame display period based on the display panel driving method according to the invention;

FIG. 7 is a figure showing sub-field-based mean emission periods on four pixel cells belonging to the (4N−3)-th display line;

FIG. 8 is a figure showing sub-field-based mean emission periods on the four pixel cells belonging to the (4N−2)-th display line;

FIG. 9 is a figure showing sub-field-based mean emission periods on the four pixel cells belonging to the (4N−1)-th display line;

FIG. 10 is a figure showing sub-field-based mean emission periods on the four pixel cells belonging to the (4N)-th display line;

FIG. 14 is a figure showing an emission drive pattern based on the first emission-drive sequence;

FIG. 15 is a figure showing an example of sub-field-based mean emission period on four pixel cells belonging to the (4N−3) display line in the case of executing the driving shown in FIG. 14;

FIG. 16 is a figure showing an example of sub-field-based mean emission period on the four pixel cells belonging to the (4N−2) display line in the case of executing the driving shown in FIG. 14;

FIG. 17 is a figure showing an example of sub-field-based mean emission period on the four pixel cells belonging to the (4N−1) display line in the case of executing the driving shown in FIG. 14;

FIG. 18 is a figure showing an example of sub-field-based mean emission period on the four pixel cells belonging to the (4N) display line in the case of executing the driving shown in FIG. 14;

FIG. 19 is a figure showing an emission drive pattern based on the second emission-drive sequence shown in FIG. 13;

FIG. 20 is a figure showing an example of sub-field-based mean emission period on the four pixel cells belonging to the (4N−3) display line in the case of executing the driving shown in FIG. 19;

FIG. 21 is a figure showing an example of sub-field-based mean emission period on the four pixel cells belonging to the (4N−2) display line in the case of executing the driving shown in FIG. 19;

FIG. 22 is a figure showing an example of sub-field-based mean emission period on the four pixel cells belonging to the (4N−1) display line in the case of executing the driving shown in FIG. 19; and FIG. 23 is a figure showing an example of sub-field-based mean emission period on the four pixel cells belonging to the (4N) display line in the case of executing the driving shown in FIG. 19.

DETAILED DESCRIPTION OF THE INVENTION

Figure 1:
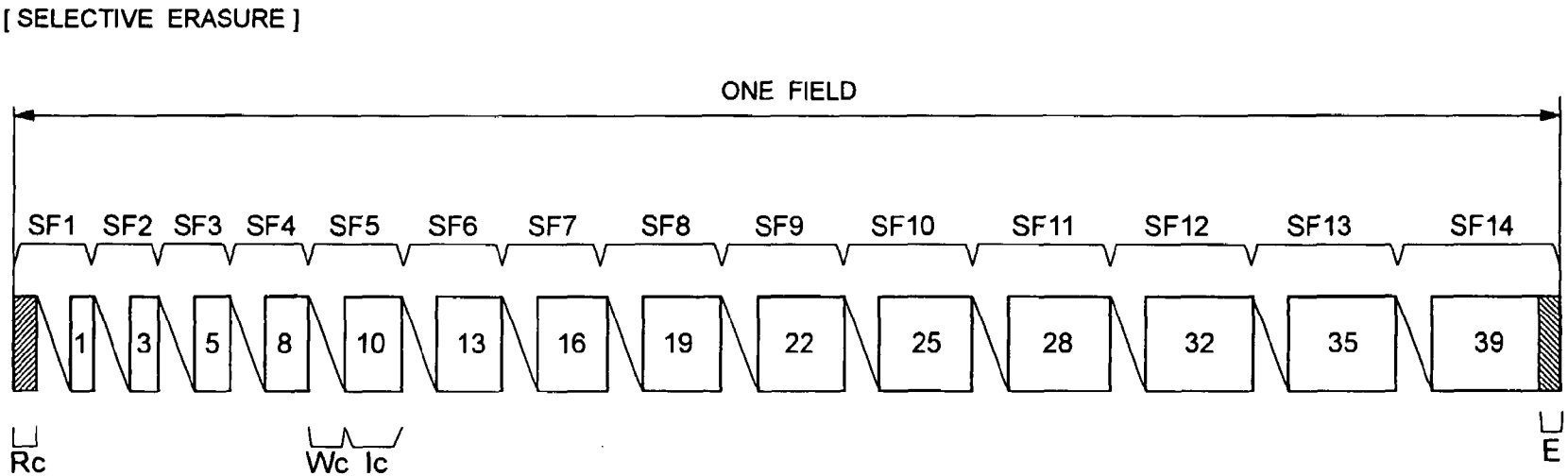
FIG. 1 is a figure showing an example of emission-drive sequence based on the sub-field technique.
Figure 3:
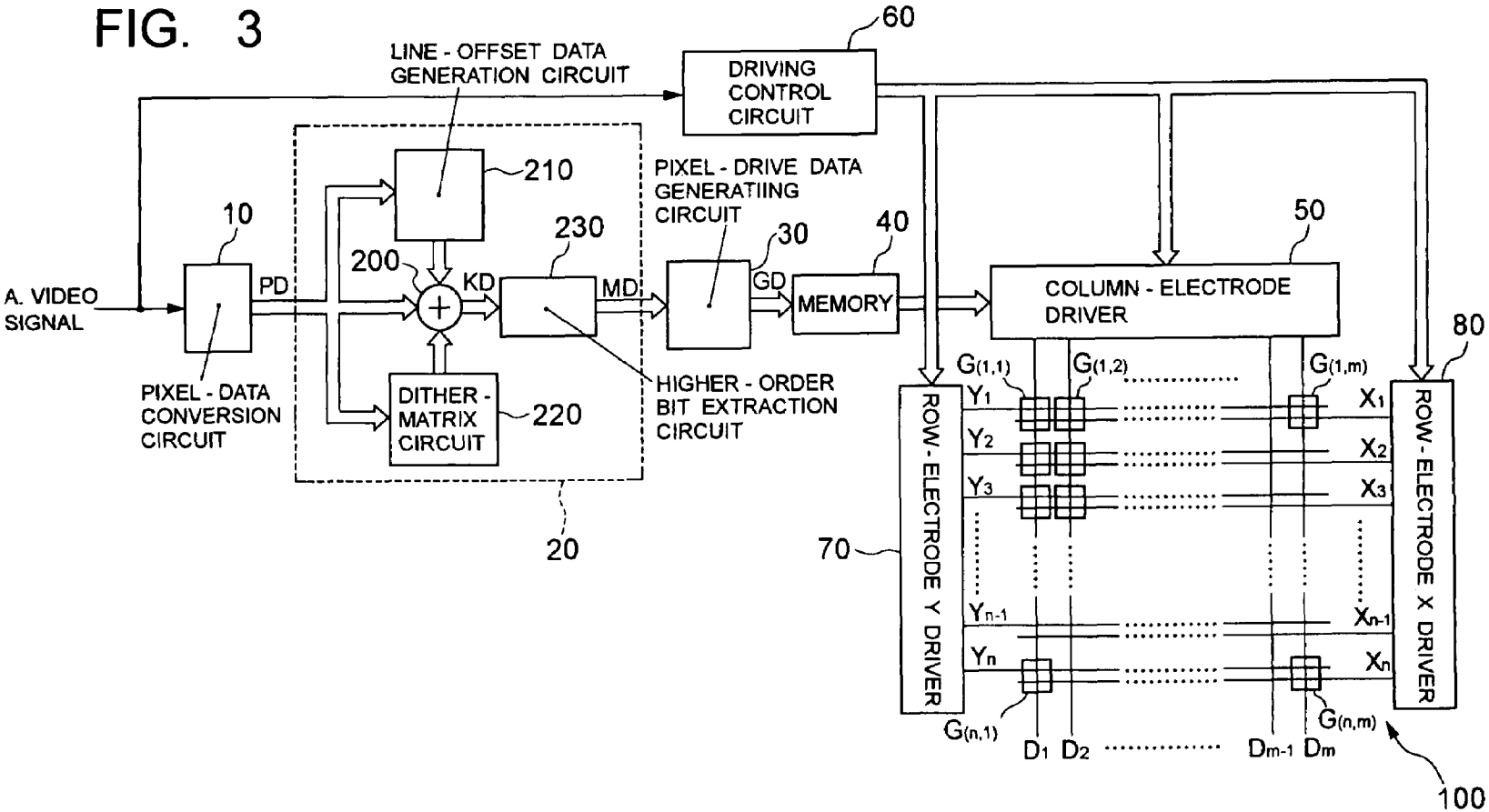
FIG. 3 is a diagram showing a schematic arrangement of a plasma display apparatus for driving a plasma display panel depending upon a display panel driving method according to the present invention.

Referring to FIG. 3, there is shown a schematic arrangement diagram of a plasma display apparatus which is to drive a plasma display panel based on a display-panel driving method according to the present invention.

In FIG. 3, a plasma display panel PDP 100 includes a front substrate (not shown) as a display surface and a back substrate (not shown) arranged in a position opposed to the front substrate sandwiching a discharge space filled with a discharge gas. On the front substrate, there are formed strip-formed row electrodes $X_1$-$X_n$ and row electrodes $Y_1$-$Y_n$ in an alternate and parallel arrangement with each other. On the back substrate, there are formed strip-formed column electrodes $D_1$-$D_m$ in an arrangement intersecting with the row electrodes. Incidentally, the row electrodes $X_1$-$X_n$ and $Y_1$-$Y_n$ are structured such that their row electrodes X and Y in pair serve respectively as the first to n-th display lines of the PDP 100. Pixel cells G, or pixels, are formed respectively at intersections (including discharge spaces) of the row electrode pairs and the column electrodes. Namely, the PDP 100 is formed thereon with pixel cells $G_{(l,l)}$-$G_{(n,m)}$ in the number of (n×m) in a matrix form.

A pixel-data conversion circuit 10 is to convert an input video signal, for example, into 5-bit pixel data PD on a pixel-by-pixel basis and supply it to a levels-increasing processing circuit 20.

The levels-increasing processing circuit 20 is configured by an adder 200, a line-offset-data generating circuit 210, a dither matrix circuit 220 and a higher-order bit extraction circuit 230.

The line-offset-data generating circuit 210, when the luminance level represented by the pixel data PD is higher than a predetermined luminance level YL, generates line-offset data as in the following and supplies it to the adder 200.

Namely, the line-offset-data generating circuit 210, when supplied with pixel data PD corresponding to the (4N−3)-th display line of the PDP 100 [N: natural number equal to or smaller than (¼)·n], supplies line-offset-data representative of "0" (decimal notation) to the adder 200. Meanwhile, when supplied with pixel data PD corresponding to the (4N−2)-th display line, the line-offset-data generating circuit 210 supplies line-offset-data representative of "1" (decimal notation) to the adder 200. When supplied with pixel data PD corresponding to the (4N−1)-th display line, the line-offset-data generating circuit 210 supplies line-offset-data representative of "2" (decimal notation) to the adder 200. When supplied with pixel data PD corresponding to the (4N)-th display line, the line-offset-data generating circuit 210 supplies line-offset-data representative of "3" (decimal notation) to the adder 200.

Incidentally, the line-offset-data generating circuit 210, when the luminance level represented by the pixel data PD is at a luminance lower than the predetermined luminance level YL, stops the line-offset data from being supplied to the adder 200.

The dither matrix circuit 220 is to generate various dither values as shown in FIG. 4A or 4B, for each pixel group having 16 pixels, or 4 pixels×4 pixels, that are adjacent vertically and horizontally of the screen correspondingly to the pixels of the pixel group, and supplies those to the adder 200.

Namely, in the case the pixel data PD represents a luminance lower than the predetermined luminance level YL, a dither value having the following is generated and supplied for 4×4 pixels a time to the adder 200, as shown in FIG. 4A.

"0" corresponding to the pixel cells belonging to the (4N−3)-th column,

"1" corresponding to the pixel cells belonging to the (4N−2)-th column,

"2" corresponding to the pixel cells belonging to the (4N−1)-th column,

"3" corresponding to the pixel cells belonging to the (4N)-th column.

Meanwhile, when the pixel data PD represents a luminance higher than the predetermined luminance level YL, a dither value having the following is generated and supplied for 4×4 pixels a time to the adder 200, as shown in FIG. 4B.

"4" corresponding to the pixel cells belonging to the (4N−3)-th column,

"5" corresponding to the pixel cells belonging to the (4N−2)-th column,

"6" corresponding to the pixel cells belonging to the (4N−1)-th column,

"7" corresponding to the pixel cells belonging to the (4N)-th column.

The adder 200 is to supply, to the higher-order bit extraction circuit 230, the 5-bit dither-added pixel data KD obtained by adding the dither value and line-offset data to the 5-bit pixel data PD supplied from the pixel-data conversion circuit 10.

The higher-order bit extraction circuit 230 is to round down the lower 2 bits of the dither-added pixel data KD and supplies the remaining higher-order 3 bits as levels-increased pixel data MD to a pixel-drive-data generating circuit 30.

Namely, the luminance level as represented by the input video signal is expressed with 6 levels by means of 3-bit level-increased pixel data MD as shown in FIG. 5.

The pixel-drive-data generating circuit 30 is to convert the levels-increased pixel data MD into 14-bit pixel drive data GD according to a data conversion table as shown in FIG. 5, and supplies it to a memory 40.

The memory 40 is to sequentially fetch and store therein pixel-based pixel-drive data GD. Each time written by pixel-drive data $GD_1$, 1-$GD_{n,m}$ in an amount of 1 frame (n rows×m columns), the pixel-drive data $GD_1$, 1-$GD_{n,m}$ is separated on a place-of-bit basis (first to fourteenth bit), the respective ones of which are read out one display-line a time correspondingly to sub-fields SF0, SF1, SF21-SF24, SF31-SF34, SF41-SF44, referred later. The memory 40 supplies the read-out pixel-drive data bits in an amount of 1-display-line (m in the number) as pixel-drive data bits DB1-DB(m) to the column-electrode driver 50.

Figure 6:
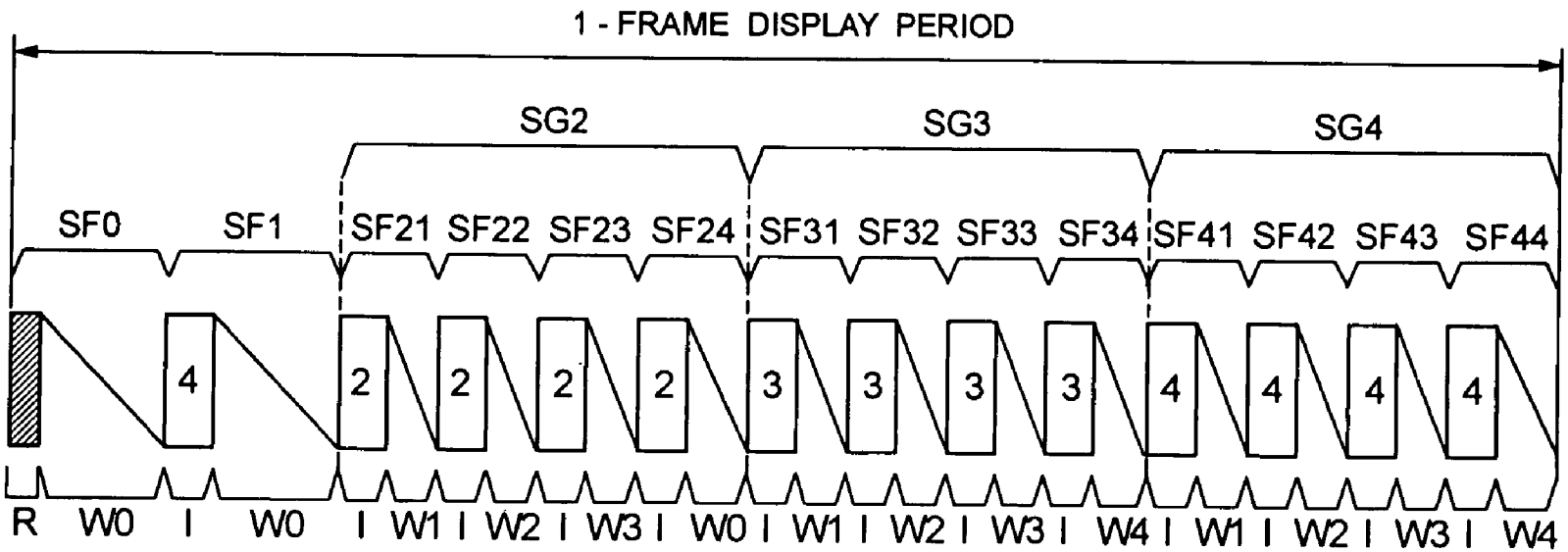
FIG. 6 is a figure showing an example of emission-drive sequence based on the display panel driving method according to the invention.

A drive control circuit 60 is to supply various timing signals for level-driving the PDP 100 to the column-electrode driver 50, row-electrode Y driver 70 and row-electrode X driver 80 according to emission-drive sequence based on the sub-field scheme as shown in FIG. 6. The column-electrode driver 50, the row-electrode Y driver 70 and row-electrode X driver 80 apply, to the column electrode D and the row electrodes X and Y of the PDP 100, various drive pulses for performing various drive process as in the following according to an emission drive sequence shown in FIG. 6.

Namely, the panel-driver section, configured by the drive control circuit 60, the column-electrode driver 50, the row-electrode Y driver 70 and the row-electrode X driver 80, performs a display driving to the PDP 100 according to the emission drive sequence shown in FIG. 6.

Incidentally, the emission-drive sequence shown in FIG. 6 has a 1-field display period having sub-fields SF0, SF1, SF21-SF24, SF31-SF34, SF41-SF44.

At first, in the head sub-field SF0, the panel-drive section executes sequentially a reset process R for initializing all the pixel cells of PDP 100 into an on-mode (state formed with a predetermined amount of wall charge) and an address process W0 for transiting the pixel cells selectively into off-mode (state erased of the wall charge) according to the pixel-drive data bits.

Then, in sub-field SF1, the panel-drive section executes, sequentially, a sustain process I for maintaining the emission only on the on-mode pixel cells over period "4" and an address process W0.

Then, in sub-field SF21, the panel-drive section executes, sequentially, a sustain process I for maintaining the emission only on the on-mode pixel cells over period "2" (twice of emissions) and an address process W1 for selectively transiting into off-mode the pixel cells belonging to the (4N)-th display line according to the pixel-drive data bits. Then, in sub-field SF22, the panel-drive section executes, sequentially, a sustain process I for maintaining the emission only on the on-mode pixel cells over period "2" (twice of emissions) and an address process W2 for selectively transiting into off-mode the pixel cells belonging to the (4N−1)-th display line according to the pixel-drive data bits. Then, in sub-field SF23, the panel-drive section executes, sequentially, a sustain process I for maintaining the emission only on the on-mode pixel cells over period "2" (twice of emissions) and an address process W3 for selectively transiting into off-mode the pixel cells belonging to the (4N−2)-th display line according to the pixel-drive data bits. Then, in sub-field SF24, the panel-drive section executes, sequentially, a sustain process I for maintaining the emission only on the on-mode pixel cells over period "2" (twice of emissions) and an address process W0 for selectively transiting into off-mode the pixel cells according to the pixel-drive data bits.

Then, in sub-field SF31, the panel-drive section executes, sequentially, a sustain process I for maintaining the emission only on the on-mode pixel cells over period "3" (three times of emissions) and an address process W1 for selectively transiting into off-mode the pixel cells belonging to the (4N)-th display line according to the pixel-drive data bits. Then, in sub-field SF32, the panel-drive section executes, sequentially, a sustain process I for maintaining the emission only on the on-mode pixel cells over period "3" (three times of emissions) and an address process W2 for selectively transiting into off-mode the pixel cells belonging to the (4N−1)-th display line according to the pixel-drive data bits. Then, in sub-field SF33, the panel-drive section executes, sequentially, a sustain process I for maintaining the emission only on the on-mode pixel cells over period "3" (three times of emissions) and an address process W3 for selectively transiting into off-mode the pixel cells belonging to the (4N−2)-th display line according to the pixel-drive data bits. Then, in sub-field SF34, the panel-drive section executes, sequentially, a sustain process I for maintaining the emission only on the on-mode pixel cells over period "3" (three times of emissions) and an address process W4 for selectively transiting into off-mode the pixel cells belonging to the (4N−3)-th display line according to the pixel-drive data bits.

Then, in sub-field SF41, the panel-drive section executes, sequentially, a sustain process I for maintaining the emission only on the on-mode pixel cells over period "4" (four-times of emissions) and an address process W1 for selectively transiting into off-mode the pixel cells belonging to the (4N)-th display line according to the pixel-drive data bits. Then, in sub-field SF42, the panel-drive section executes, sequentially, a sustain process I for maintaining the emission only on the on-mode pixel cells over period "4" (four-times of emissions) and an address process W2 for selectively transiting into off-mode the pixel cells belonging to the (4N−1)-th display line according to the pixel-drive data bits. Then, in sub-field SF43, the panel-drive section executes, sequentially, a sustain process I for maintaining the emission only on the on-mode pixel cells over period "4" (four-times of emissions) and an address process W3 for selectively transiting into off-mode the pixel cells belonging to the (4N−2)-th display line according to the pixel-drive data bits. Then, in sub-field SF44, the panel-drive section executes, sequentially, a sustain process I for maintaining the emission only on the on-mode pixel cells over period "4" (four-times of emissions) and an address process W4 for selectively transiting into off-mode the pixel cells belonging to the (4N−3)-th display line according to the pixel-drive data bits.

Here, in the emission drive sequence shown in FIG. 6, the occasion the pixel cell is allowed to transit from off-mode to on-mode is only in the reset process R of the head sub-field SF0 of among the sub-fields of within a 1-frame display period as a unit display period. Namely, in case the pixel cell is set in an off-mode in the address process (W0, W1, W2, W3 or W4) of one of sub-fields SF0, SF1, SF21-SF24, SF31-SF34, SF41-SF44, this pixel cell cannot be returned to the on-mode in the subsequent sub-fields. In this case, in the case the pixel-drive data bit is at logical level 1, the pixel cell is set to off-mode in the address process (W0, W1, W2, W3 or W4) of the sub-field corresponding to the place of bit thereof.

Consequently, the pixel cell performs a sustain-discharge emission (shown by the white circles) in the sustain processes I of the successive sub-fields of from the beginning, before a setting to off-mode in the address process of sub-field shown by the black circle in FIG. 5. In this case, visual perception is available at the intermediate luminance in a level corresponding to the total emission period of a 1-frame display period due to sustain-discharge emission.

Namely, the panel-drive section performs driving according to an emission pattern different in the total emission period of within the 1-frame display period as shown in FIG. 5, in accordance with the dither-added pixel data KD expressing the luminance represented by the input video signal in 6 levels.

For example, when the dither-added pixel data KD is at [000] representative of the lowest luminance level, the panel-drive section sets the pixel cell to off-mode in the address process W0 of the head sub-field SF0 as shown by the black circle. In this case, the lowest luminance level 0 is to be expressed because of no occurrence of sustain-discharge emission at all in the sustain process I throughout the 1-frame display period.

Meanwhile, when the dither-added pixel data KD is at [001] representative of a luminance one-level higher than the above [000], the panel-drive section sets the pixel cell to off-mode only in the address process W0 of sub-field SF1 as shown by the black circle. In this case, the luminance level is to be expressed corresponding to the period "4" because of an occurrence of sustained emission over period "4" only in the sustain process I of sub-field SF1 throughout the 1-frame display period.

Meanwhile, when the dither-added pixel data KD is at [010] representative of a luminance one-level higher than the above [001], the panel-drive section sets the pixel cell to off-mode only in the address process W0 of sub-field SF24 as shown by the black circle. In this case, the luminance level is to be expressed corresponding to the total emission period "12" because of occurrence of sustained emission over period "4" in the sustain process I of sub-field SF1 and over period "2" in the sustain processes I of each of sub-fields SF21-SF24.

Incidentally, when the dither-added pixel data KD represents a luminance higher than [011], the panel-drive section performs an emission drive with different emission patterns of within 1-frame display period in accordance with the dither-added pixel data KD, to between the pixel cells belonging to the four display lines adjacent vertically of the screen, i.e. to between the following pixel cells:

pixel cells belonging to the (4N−3)-th display line, pixel cells belonging to the (4N−2)-th display line, pixel cells belonging to the (4N−1)-th display line and pixel cells belonging to the (4N)-th display line.

For example, in the case the dither-added pixel data KD is at [011], the panel-drive section sets to off-mode the pixel cells belonging to the (4N)-th display line, i.e. the fourth, eighth, twelfth, . . . , and n-th display lines, only in the address process W1 of sub-field SF21, as shown by the black circle. In this case, the pixel cells belonging to the (4N)-th display line, because emission is maintained only in the sustain processes I of sub-fields SF1 and SF2, are expressed at the luminance level corresponding to the total emission period "6" (total number of times of emissions: 6) thereof. Meanwhile, in the case similarly the dither-added pixel data KD is at [011], the panel-drive section sets to off-mode the pixel cells belonging to the (4N−1)-th display line, i.e. the third, seventh, eleventh, . . . , and (n−1)-th display lines, only in the address process W2 of sub-field SF22. In this case, the pixel cells belonging to the (4N−1)-th display line, because emission is maintained only in the sustain processes I of sub-fields SF1, SF21 and SF22, are expressed at the luminance level corresponding to the total emission period "8" (total number of times of emissions: 8) thereof. Meanwhile, in the case similarly the dither-added pixel data KD is at [011], the panel-drive section sets to off-mode the pixel cells belonging to the (4N−2)-th display line, i.e. the second, sixth, tenth, . . . , and (n−2)-th display lines, only in the address process W3 of sub-field SF23. In this case, the pixel cells belonging to the (4N−2)-th display line, because emission is maintained only in the sustain processes I of sub-fields SF1, SF21-SF23, are expressed at the luminance level corresponding to the total emission period "10" (total number of times of emissions: 10) thereof. Meanwhile, in the case similarly the dither-added pixel data KD is at [011], the panel-drive section sets to off-mode the pixel cells belonging to the (4N−3)-th display line, i.e. the first, fifth, ninth, . . . , and (n−3)-th display lines, only in the address process W0 of sub-field SF24. In this case, the pixel cells belonging to the (4N−3)-th display line, because emission is maintained only in the sustain processes I of sub-fields SF1, SF21-SF24, are expressed at the luminance level corresponding to the total emission period "12" (total number of times of emissions: 12) thereof.

Namely, emission is caused at respective luminance levels of:

"6" on the pixel cell belonging to the (4N)-th display line,

"8" on the pixel cell belonging to the (4N−1)-th display line,

"10" on the pixel cell belonging to the (4N−2)-th display line, and

"12" on the pixel cell belonging to the (4N−3)-th display line, according to the dither-added pixel data KD of [011] representative of a luminance level higher in luminance than the predetermined luminance level.

Similarly, emission is caused at respective luminance levels of:

"15" on the pixel cell belonging to the (4N)-th display line,

"18" on the pixel cell belonging to the (4N−1)-th display line,

"21" on the pixel cell belonging to the (4N−2)-th display line, and "24" on the pixel cell belonging to the (4N−3)-th display line, according to the dither-added pixel data KD of [100] representative of a luminance one-level higher than [011].

Furthermore, emission is caused at respective luminance levels of:

"28" on the pixel cell belonging to the (4N)-th display line,

"32" on the pixel cell belonging to the (4N−1)-th display line,

"36" on the pixel cell belonging to the (4N−2)-th display line, and

"40" on the pixel cell belonging to the (4N−3)-th display line, according to the dither-added pixel data KD of [101] representative of the highest luminance.

As described above, in the case the input video signal (pixel data PD) represents a luminance level higher than a predetermined luminance level YL, emission luminance level is given different on between the pixel cells belonging to the four display lines adjacent vertically of the screen, i.e.

the pixel cells belonging to the (4N)-th display line, the pixel cells belonging to the (4N−1)-th display line, the pixel cells belonging to the (4N−2)-th display line, and the pixel cells belonging to the (4N−3)-th display line, according to the dither-added pixel data KD.

In brief, line dithering is carried out only in the case the dither-added pixel data KD represents a luminance higher than [011]. In this case, both of driving with line dithering (KD=[010]) and driving with no line dithering (KD=[011]) are performed in the sub-fields SF21-SF24 following the sub-field SF1 (without line dithering) for emission of low-luminance components and serving for emission at a luminance one-level higher than SF1.

Incidentally, the dither-added pixel data KD is the one obtained by extracting the higher 3 bits from the 5-bit addition result obtained by adding line offset data and dither value to the pixel data PD corresponding to the input video signal. Accordingly, even when the pixel data PD corresponding to the respective 16 pixels (pixel cells) of 4×4 pixels adjacent vertically and horizontally of the screen represents a luminance level equal in the entirety for example, emission pattern is not necessarily provided equal within the 1-frame display period of the pixel. In this case, visual perception is available at a luminance level corresponding to the total (within 1-frame display period) of sub-field-based mean emission periods over adjacent four pixels.

FIG. 7 shows dither-added pixel data $KD_{(1,1)}$, $KD_{(1,2)}$, $KD_{(1,3)}$, $KD_{(1,4)}$ corresponding respectively to pixel cells $G_{(1,1)}$, $G_{(1,2)}$, $G_{(1,3)}$, $G_{(1,4)}$, for example, belonging to the (4N−3)-th display line of the PDP 100, and mean emission periods in sub-fields due to emission over the four pixel cells $G_{(1,1)}$, $G_{(1,2)}$, $G_{(1,3)}$, $G_{(1,4)}$. Meanwhile, FIG. 8 shows dither-added pixel data $KD_{(2,1)}$, $KD_{(2,2)}$, $KD_{(2,3)}$, $KD_{(2,4)}$ corresponding respectively to pixel cells $G_{(2,1)}$, $G_{(2,2)}$, $G_{(2,3)}$, $G_{(2,4)}$, for example, belonging to the (4N−2)-th display line, and mean emission periods in sub-fields due to emission over the four pixel cells $G_{(2,1)}$, $G_{(2,2)}$, $G_{(2,3)}$, $G_{(2,4)}$. Meanwhile, FIG. 9 shows dither-added pixel data $KD_{(3,1)}$, $KD_{(3,2)}$, $KD_{(3,3)}$, $KD_{(3,4)}$ corresponding respectively to pixel cells $G_{(3,1)}$, $G_{(3,2)}$, $G_{(3,3)}$, $G_{(3,4)}$, for example, belonging to the (4N−1)-th display line, and mean emission periods in sub-fields due to emission over the four pixel cells $G_{(3,1)}$, $G_{(3,2)}$, $G_{(3,3)}$, $G_{(3,4)}$. Meanwhile, FIG. 10 shows dither-added pixel data $KD_{(4,1)}$, $KD_{(4,2)}$, $KD_{(4,3)}$, $KD_{(4,4)}$ corresponding respectively to pixel cells $G_{(4,1)}$, $G_{(4,2)}$, $G_{(4,3)}$, $G_{(4,4)}$, for example, belonging to the (4N)-th display line, and mean emission periods in sub-fields due to emission over the four pixel cells $G_{(4,1)}$, $G_{(4,2)}$, $G_{(4,3)}$, $G_{(4,4)}$.

Here, when the luminance level represented by the pixel data PD is a low luminance smaller than a luminance level "8" (=predetermined luminance level YL), emission is equally caused on the pixel cells belonging to the (4N−3)-th, (4N−2)-th, (4N−1)-th, (4N)-th display lines as shown in FIGS. 7 to 10. Meanwhile, when the luminance level represented by the pixel data PD is a low luminance smaller than a luminance level "8" (=predetermined luminance level YL), dither values "0", "1", "2", "3" as shown in FIG. 4A are respectively added to those of pixel data PD corresponding to the adjacent four pixel cells without an addition of line-offset data.

Now explanation is made on the emitting operation to be effected according to the pixel data PD representative of a luminance level "0"-"8", by excerpting the pixel cells $G_{(1,1)}$, $G_{(1,2)}$, $G_{(1,3)}$, $G_{(1,4)}$ belonging to the (4N−3)-th display line.

First of all, where the pixel data PD (5 bits) corresponding to the pixel cells $G_{(1,1)}$, $G_{(1,2)}$, $G_{(1,3)}$, $G_{(1,4)}$ represents a luminance level "0", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[000]
$KD_{(1,2)}$=[000]
$KD_{(1,3)}$=[000]
$KD_{(1,4)}$=[000]

Accordingly, the pixel cells $G_{(1,1)}$, $G_{(1,2)}$, $G_{(1,3)}$, $G_{(1,4)}$ are set to off-mode in the address process W0 of sub-field SF0 as shown in FIG. 5, according to the dither-added pixel data KD of [000]. Thus, the total emission period over four pixel cells $G_{(1,1)}$, $G_{(1,2)}$, $G_{(1,3)}$, $G_{(1,4)}$ is given "0" in the 1-frame display period. This provides a visual perception at a luminance in a level corresponding to the mean emission period "0" per pixel cell thereof.

Meanwhile, in the case the pixel data PD represents a luminance level "1", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[000]
$KD_{(1,2)}$=[000]
$KD_{(1,3)}$=[000]
$KD_{(1,4)}$=[001]

Accordingly, the pixel cells $G_{(1,1)}$, $G_{(1,2)}$, $G_{(1,3)}$, are set to off-mode in the address process W0 of sub-field SF0 as shown in FIG. 5, according to the dither-added pixel data KD of [000]. Thus, off state, i.e. "0" luminance-level state, is maintained throughout the 1-frame display period. Meanwhile, because the pixel cell $G_{(1,4)}$ is set in an off-mode in the address process W0 of sub-field SF1 as shown in FIG. 5 according to the dither-added pixel data KD of [001], emission is maintained over the period "4" in the sustain process I of sub-field SF1. Accordingly, the total emission period based on the four pixel cells $G_{(1,1)}$, $G_{(1,2)}$, $G_{(1,3)}$, $G_{(1,4)}$ is given "4"

within the 1-frame display period. This provides a visualperception at a luminance in a level corresponding to the mean emission period "1" per pixel cell thereof.

Meanwhile, in the case the pixel data PD represents a luminance level "2", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[000]
$KD_{(1,2)}$=[000]
$KD_{(1,3)}$=[001]
$KD_{(1,4)}$=[001]

Accordingly, because the pixel cells $G_{(1,1)}$, $G_{(1,2)}$ are set to off-mode in the address process W0 of sub-field SF0 as shown in FIG. 5 according to the dither-added pixel data KD of [000], off state, i.e. "0" luminance level state, is maintained throughout the 1-frame display period. Meanwhile, because the pixel cells $G_{(1,3)}$ and $G_{(1,4)}$ are set to off-mode in the address process W0 of sub-field SF1 as shown in FIG. 5 according to the dither-added pixel data KD of [001], emission is maintained over the period "4" in the sustain process I of sub-field SF1. Accordingly, the total emission period over the four pixel cells $G_{(1,1)}$, $G_{(1,2)}$, $G_{(1,3)}$, $G_{(1,4)}$ is given "8" within the 1-frame display period. This provides a visual perception at a luminance in a level corresponding to the mean emission period "2" per pixel cell thereof.

Meanwhile, in the case the pixel data PD represents a luminance level "3", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[000]
$KD_{(1,2)}$=[001]
$KD_{(1,3)}$=[001]
$KD_{(1,4)}$=[001]

Accordingly, because the pixel cell $G_{(1,1)}$ is set to off-mode in the address process W0 of sub-field SF0 as shown in FIG. 5 according to the dither-added pixel data KD of [000], off state, i.e. "0" luminance level state, is maintained throughout the 1-frame display period. Meanwhile, because the pixel cells $G_{(1,2)}$, $G_{(1,3)}$ and $G_{(1,4)}$ are set to off-mode in the address process W0 of sub-field SF1 as shown in FIG. 5 according to the dither-added pixel data KD of [001], emission is maintained over the period "4" in the sustain process I of sub-field SF1. Accordingly, the total emission period over the four pixel cells $G_{(1,1)}$, $G_{(1,2)}$, $G_{(1,3)}$, $G_{(1,4)}$ is given "12" within the 1-frame display period. This provides a visual perception at a luminance in a level corresponding to the mean emission period "3" per pixel cell thereof.

Meanwhile, in the case the pixel data PD represents a luminance level "4", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[001]
$KD_{(1,2)}$=[001]
$KD_{(1,3)}$=[001]
$KD_{(1,4)}$=[001]

Accordingly, because the pixel cells $G_{(1,1)}$, $G_{(1,2)}$, $G_{(1,3)}$ and $G_{(1,4)}$ are set to off-mode in the address process W0 of sub-field SF1 as shown in FIG. 5 according to the dither-added pixel data KD of [001], emission is maintained over the period "4" in the sustain process I of sub-field SF1. Accordingly, the total emission period over the four pixel cells $G_{(1,1)}$, $G_{(1,2)}$, $G_{(1,3)}$, $G_{(1,4)}$ is given "16" within the 1-frame display period. This provides a visual perception at a luminance in a level corresponding to the mean emission period "4" per pixel cell thereof.

Meanwhile, in the case the pixel data PD represents a luminance level "5", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[001]
$KD_{(1,2)}$=[001]
$KD_{(1,3)}$=[001]
$KD_{(1,4)}$=[010]

Accordingly, because the pixel cells $G_{(1,1)}$, $G_{(1,2)}$ and $G_{(1,3)}$ are set to off-mode in the address process W0 of sub-field SF1 as shown in FIG. 5 according to the dither-added pixel data KD of [001], emission is maintained over the period "4" in the sustain process I of sub-field SF1. Meanwhile, the pixel cell $G_{(1,4)}$ is set to off-mode in the address process W0 of sub-field SF24 as shown in FIG. 5 according to the dither-added pixel data KD of [010]. Accordingly, emission is maintained on the pixel cell $G_{(1,4)}$ over the period "4" in the sustain process I of sub-field SF1 and over the period "2" in the sustain process I of each of sub-fields SF21-SF24. In this case, the mean emission period over the four pixel cells $G_{(1,1)}$, $G_{(1,2)}$, $G_{(1,3)}$, $G_{(1,4)}$ within the sub-field SF1 is "4" while the mean emission period of those within the sub-fields SF21-SF24 is "0.5". This provides a visual perception possible at a luminance in a level corresponding to the sum "6" of sub-field-based mean emission period within the 1-frame display period.

Meanwhile, in the case the pixel data PD represents a luminance level "6", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[001]
$KD_{(1,2)}$=[001]
$KD_{(1,3)}$=[010]
$KD_{(1,4)}$=[010]

Accordingly, because the pixel cells $G_{(1,1)}$ and $G_{(1,2)}$ are set to off-mode in the address process W0 of sub-field SF1 as shown in FIG. 5 according to the dither-added pixel data KD of [001], emission is maintained over the period "4" in the sustain process I of sub-field SF1. Meanwhile, the pixel cells $G_{(1,3)}$ and $G_{(1,4)}$ are set to off-mode in the address process W0 of sub-field SF24 as shown in FIG. 5 according to the dither-added pixel data KD of [010]. Accordingly, emission is maintained on the pixel cells $G_{(1,3)}$ and $G_{(1,4)}$ over the period "4" in the sustain process I of sub-field SF1 and over the period "2" in the sustain process I of sub-fields SF21-SF24. In this case, the mean emission period over the four pixel cells $G_{(1,1)}$, $G_{(1,2)}$, $G_{(1,3)}$, $G_{(1,4)}$ within the sub-field SF1 is "4" while the mean emission period of those within the sub-fields SF21-SF24 is "1". This accordingly provides a visual perception at a luminance in a level corresponding to the sum "8" of sub-field-based mean emission period within the 1-frame display period.

Meanwhile, in the case the pixel data PD represents a luminance level "7", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[001]
$KD_{(1,2)}$=[010]
$KD_{(1,3)}$=[010]
$KD_{(1,4)}$=[010]

Accordingly, because the pixel cell $G_{(1,1)}$ is set to off-mode in the address process W0 of sub-field SF1 as shown in FIG. 5 according to the dither-added pixel data KD of [001], emission is maintained over the period "4" in the sustain process I of sub-field SF1. Meanwhile, the pixel cells $G_{(1,2)}$, $G_{(1,3)}$ and $G_{(1,4)}$ are set to off-mode in the address process W0 of sub-field SF24 as shown in FIG. 5 according to the dither-added pixel data KD of [010]. Accordingly, emission is maintained on the pixel cells $G_{(1,2)}$, $G_{(1,3)}$ and $G_{(1,4)}$ over the period "4" in the sustain process I of sub-field SF1 and over the period "2" in the sustain process I of sub-fields SF21-SF24. In this case, the mean emission period over the four pixel cells $G_{(1,1)}$, $G_{(1,2)}$, $G_{(1,3)}$, $G_{(1,4)}$ within the sub-field SF1 is "4" while the mean emission period over those within the sub-fields SF21-SF24 is "1.5". This accordingly provides a visual perception at a luminance in a level corresponding to the sum "10" of sub-field-based mean emission period within the 1-frame display period.

Meanwhile, in the case the pixel data PD represents a luminance level "8", dither values "0", "1", "2", "3" are added respectively to those thereby extracting the higher-order 3 bits of the addition result. Thereupon, dither-added pixel data $KD_{(1,1)}$, $KD_{(1,2)}$, $KD_{(1,3)}$, $KD_{(1,4)}$ is generated comprising the followings.

$KD_{(1,1)}$=[010]
$KD_{(1,2)}$=[010]
$KD_{(1,3)}$=[010]
$KD_{(1,4)}$=[010]

Accordingly, the pixel cells $G_{(1,1)}$, $G_{(1,2)}$, $G_{(1,3)}$ and $G_{(1,4)}$ are set to off-mode in the address process W0 of sub-field SF24 as shown in FIG. 5 according to the dither-added pixel data KD of [010]. Accordingly, emission is maintained on the pixel cells $G_{(1,1)}$, $G_{(1,2)}$, $G_{(1,3)}$ and $G_{(1,4)}$ over the period "4" in the sustain process I of sub-field SF1 and over the period "2" in the sustain process I of each of sub-fields SF21-SF24. In this case, the mean emission period over the four pixel cells $G_{(1,1)}$, $G_{(1,2)}$, $G_{(1,3)}$, $G_{(1,4)}$ within the sub-field SF1 is "4" while the mean emission period over those within the sub-fields SF21-SF24 is "2". This accordingly provides a visual perception at a luminance in a level corresponding to the sum "12" of sub-field-based mean emission period within the 1-frame display period.

Now explanation is made on the emitting operation at a luminance level represented by pixel data PD higher than "8" (=predetermined luminance level YL), on each of the (4N−3)-th, (4N−2)-th, (4N−1)-th and (4N)-th display line groups separately.

Incidentally, in this case, dither values "4", "5", "6" and "7" as shown in FIG. 4B are added respectively to those of pixel data PD corresponding to the four pixel cells adjacent horizontally of the screen. Furthermore, line-offset data "0", "1", "2", "3" are added respectively to those of pixel data PD corresponding to the four pixel cells adjacent vertically of the screen. The higher-order 3 bits of the addition result are generated as dither-added pixel data KD.

[Pixel Cells Belonging to the (4N−3)-th Display Line]

First of all, in the case the pixel data PD (5 bits) corresponding to the four pixel cells $G_{(1,1)}$, $G_{(1,2)}$, $G_{(1,3)}$, $G_{(1,4)}$ represents a luminance level "9", in case dither values "4", "5", "6", "7" are added respectively to those thereby extracting the higher-order 3 bits of addition result, dither-added pixel data $KD_{(1,1)}$, $KD_{(1,2)}$, $KD_{(1,3)}$, $KD_{(1,4)}$ is generated comprising the followings as shown in FIG. 7.

$KD_{(1,1)}$=[011]
$KD_{(1,2)}$=[011]
$KD_{(1,3)}$=[011]
$KD_{(1,4)}$=[100]

Accordingly, the pixel cells $G_{(1,1)}$, $G_{(1,2)}$ and $G_{(1,3)}$ are set to off-mode in the address process W0 of sub-field SF24 as shown in FIG. 5, according to the dither-added pixel data KD of [011]. Thus, emission is maintained on the pixel cells $G_{(1,1)}$, $G_{(1,2)}$ and $G_{(1,3)}$ over period "4" in the sustain process I of sub-field SF1 and over period "2" in the sustain process I of each of sub-fields SF21-SF24. Meanwhile, the pixel cell $G_{(1,4)}$ iS set to off-mode in the address process W4 of sub-field SF34 as shown in FIG. 5, according to the dither-added pixel data KD of [100]. Thus, emission is maintained on the pixel cells $G_{(1,4)}$ over period "4" in the sustain process I of sub-field SF1, over period "2" in the sustain process I of each of sub-fields SF21-SF24 and over period "3" in the sustain process I of each of sub-fields SF31-SF34. In this case, the mean emission period in the sub-field SF1 is "4", the mean emission period in each of sub-fields SF21-SF24 is "2" and the mean emission period in each of sub-fields SF31-SF34 is "0.75", over the four pixel cells $G_{(1,1)}$, $G_{(1,2)}$, $G_{(1,3)}$ and $G_{(1,4)}$). This accordingly provides a visual perception at a luminance in a level corresponding to the sum "15" of the mean emission period over those in the sub-fields of within the 1-frame display period.

Meanwhile, in the case the pixel data PD corresponding to the four pixel cells $G_{(1,1)}$, $G_{(1,2)}$, $G_{(1,3)}$, $G_{(1,4)}$ represents a luminance level "10", in case dither values "4", "5", "6", "7" are added respectively to those thereby extracting the higher-order 3 bits of the addition result, dither-added pixel data $KD_{(1,1)}$, $KD_{(1,2)}$, $KD_{(1,3)}$, $KD_{(1,4)}$ is generated comprising the followings as shown in FIG. 7.

$KD_{(1,1)}$=[011]
$KD_{(1,2)}$=[011]
$KD_{(1,3)}$=[100]
$KD_{(1,4)}$=[100]

Accordingly, the pixel cells $G_{(1,1)}$ and $G_{(1,2)}$ are set to off-mode in the address process W0 of sub-field SF24 as shown in FIG. 5, according to the dither-added pixel data KD of [011]. Thus, emission is maintained on the pixel cells $G_{(1,1)}$ and $G_{(1,2)}$ over period "4" in the sustain process I of sub-field SF1 and over period "2" in the sustain processes I of sub-fields SF21-SF24. Meanwhile, the pixel cells $G_{(1,3)}$ and $G_{(1,4)}$ are set to off-mode in the address process W4 of sub-field SF34 as shown in FIG. 5, according to the dither-added pixel data KD of [100]. Thus, emission is maintained on the pixel cells $G_{(1,3)}$ and $G_{(1,4)}$ over period "4" in the sustain process I of sub-field SF1, over period "2" in the sustain process I of each of sub-fields SF21-SF24 and over period "3" in the sustain process I of sub-fields SF31-SF34. In this case, the four pixel cells $G_{(1,2)}$, $G_{(1,2)}$, $G_{(1,3)}$ and $G_{(1,4)}$ have a mean emission period of "4" in the sub-field SF1, a mean emission period of "2" in each of the sub-fields SF21-SF24, and a mean emission period of "1.5" in each of the sub-fields SF31-SF34. This accordingly provides a visual perception at a luminance in a level corresponding to the sum "18" of the mean emission period over those of the sub-fields of within the 1-frame display period.

[Pixel Cells Belonging to the (4N−2)-th Display Line]

First, in the case the pixel data PD corresponding to the four pixel cells $G_{(2,1)}$, $G_{(2,2)}$, $G_{(2,3)}$, $G_{(2,4)}$ represents a luminance level "9", dither values "4", "5", "6" and "7" are added respectively to and further line-offset data "1" is added to those thereby extracting the higher-order 3 bits of addition result. Thereupon, dither-added pixel data $KD_{(2,1)}$, $KD_{(2,2)}$, $KD_{(2,3)}$, $KD_{(3,4)}$ is generated comprising the followings as shown in FIG. 8.

$KD_{(2,1)}$=[011]
$KD_{(2,2)}$=[011]
$KD_{(2,3)}$=[100]
$KD_{(2,4)}$=[100]

Accordingly, the pixel cells $G_{(2,1)}$ and $G_{(2,2)}$ are set to off-mode in the address process W3 of sub-field SF23 as shown in FIG. 5, according to the dither-added pixel data KD of [011]. Thus, emission is maintained on the pixel cells $G_{(2,1)}$ and $G_{(2,2)}$ over period "4" in the sustain process I of sub-field SF1, and over period "2" in the sustain processes I of each of sub-fields SF21-SF23. Meanwhile, the pixel cells $G_{(2,3)}$ and $G_{(2,4)}$ are set to off-mode in the address process W3 of sub-field SF33 as shown in FIG. 5, according to the dither-added pixel data KD of [100]. Thus, emission is maintained on the pixel cells $G_{(2,3)}$ and $G_{(2,4)}$ over period "4" in the sustain process I of sub-field SF1, over period "2" in the sustain process I of each of sub-fields SF21-SF24 and over period "3" in the sustain process I of each of sub-fields SF31-SF33. In this case, the four pixels cells $G_{(2,1)}$, $G_{(2,2)}$, $G_{(2,3)}$, $G_{(2,4)}$ have a mean emission period of "4" in the sub-field SF1, a mean emission period of "2" in each of the sub-fields SF21-SF23, a mean emission period of "1" in the sub-field SF24 and a mean emission period of "1.5" in each of sub-fields SF31-SF33. This accordingly provides a visual perception at a luminance in a level corresponding to the sum "15.5" over the sub-field-based mean emission periods of within the 1-frame display period.

Meanwhile, in the case the pixel data PD corresponding to the four pixel cells $G_{(2,1)}$, $G_{(2,2)}$, $G_{(2,3)}$, $G_{(2,4)}$ represents a luminance level "10", dither values "4", "5", "6", "7" are added respectively to and further line-offset data "1" is added to those thereby extracting the higher-order 3 bits of the addition result. Thereupon, dither-added pixel data $KD_{(2,1)}$, $KD_{(2,2)}$, $KD_{(2,3)}$, $KD_{(2,4)}$ is generated comprising the followings as shown in FIG. 8.

$KD_{(2,1)}$=[011]
$KD_{(2,2)}$=[100]
$KD_{(2,3)}$=[100]
$KD_{(2,4)}$=[100]

Accordingly, the pixel cells $G_{(2,1)}$ is set to off-mode in the address process W3 of sub-field SF23 as shown in FIG. 5, according to the dither-added pixel data KD of [011]. Thus, emission is maintained on the pixel cell $G_{(2,1)}$ over period "4" in the sustain process I of sub-field SF1 and over period "2" in the sustain process I of sub-fields SF21-SF23. Meanwhile, the pixel cells $G_{(2,2)}$, $G_{(2,3)}$ and $G_{(2,4)}$ are set to off-mode in the address process W3 of sub-field SF33 as shown in FIG. 5, according to the dither-added pixel data KD of [100]. Thus, emission is maintained on the pixel cells $G_{(2,2)}$, $G_{(2,3)}$ and $G_{(2,4)}$ over period "4" in the sustain process I of sub-fields SF1, over period "2" in the sustain process I of sub-fields SF21-SF24, and over period "3" in the sustain process I of sub-fields SF31-SF33. In this case, the four pixel cells $G_{(2,1)}$, $G_{(2,2)}$, $G_{(2,3)}$ and $G_{(2,4)}$ have a mean emission period of "4" in the sub-field SF1, a mean emission period of "2" in each of the sub-fields SF21-SF23, and a mean emission period of "1.5" in the sub-field SF24, and a mean emission period of "2.25" in each of sub-fields SF31-SF33. This accordingly provides a visual perception at a luminance in a level corresponding to the sum "18.25" of sub-field-based mean emission periods of within the 1-frame display period.

[Pixel Cells Belonging to the (4N−1)-th Display Line]

First, in the case the pixel data PD corresponding to the four pixel cells $G_{(3,1)}$, $G_{(3,2)}$, $G_{(3,3)}$, $G_{(3,4)}$ represents a luminance level "9", dither values "4", "5", "6", "7" are added respectively to and further line-offset data "2" is added to those thereby extracting the higher-order 3 bits of addition result. Thereupon, dither-added pixel data $KD_{(3,1)}$, $KD_{(3,2)}$, $KD_{(3,3)}$, $KD_{(3,4)}$ is generated comprising the followings as shown in FIG. 9.

KD(3, 1)=[011]
KD(3, 2)=[100]
KD(3, 3)=[100]
KD(3, 4)=[100]

Accordingly, the pixel cell $G_{(3,1)}$ is set to off-mode in the address process W2 of sub-field SF22 as shown in FIG. 5, according to the dither-added pixel data KD of [011]. Thus, emission is maintained on the pixel cell $G_{(3,1)}$ over period "4" in the sustain process I of sub-field SF1, and over period "2" in the sustain process I of each of sub-fields SF21 and SF22. Meanwhile, the pixel cells $G_{(3,2)}$, $G_{(3,3)}$ and $G_{(3,4)}$ are set to off-mode in the address process W2 of sub-field SF32 as shown in FIG. 5, according to the dither-added pixel data KD of [100]. Thus, emission is maintained on the pixel cells $G_{(3,2)}$, $G_{(3,3)}$ and $G_{(3,4)}$ over period "4" in the sustain process I of sub-field SF1, over period "2" in the sustain process I of each of sub-fields SF21-SF24 and over period "3" in the sustain process I of each of sub-fields SF31 and SF32. In this case, the four pixel cells $G_{(3,1)}$, $G_{(3,2)}$, $G_{(3,3)}$, $G_{(3,4)}$ have a mean emission period of "4" in the sub-field SF1, a mean emission period of "2" in each of sub-fields SF21 and SF22, a mean emission period of "1.5" in each of sub-field SF23 and SF24 and a mean emission period of "2.25" in each of sub-fields SF31 and SF32. This accordingly provides a visual perception at a luminance in a level corresponding to the sum "15.5" of sub-field-based mean emission period of within the 1-frame display period.

Meanwhile, in the case the pixel data PD corresponding to four pixel cells $G_{(3,1)}$, $G_{(3,2)}$, $G_{(3,3)}$, $G_{(3,4)}$ represents a luminance level "10", dither values "4", "5", "6", "7" are added respectively to and further line-offset data "2" is added to those thereby extracting the higher-order 3 bits of the addition result. Thereupon, dither-added pixel data $KD(_{3,1})$, $KD_{(3,2)}$, $KD_{(3,3)}$, $KD_{(3,4)}$ is generated comprising the followings, as shown in FIG. 9.

$KD_{(3,1)}$=[100]
$KD_{(3,2)}$=[100]
$KD_{(3,3)}$=[100]
$KD_{(3,4)}$=[100]

Accordingly, the pixel cells $G_{(3,1)}$, $G_{(3,2)}$, $G_{(3,3)}$ and $G_{(3,4)}$ are set to off-mode in the address process W2 of sub-field SF32 as shown in FIG. 5, according to the dither-added pixel data KD of [100]. Thus, emission is maintained on the pixel cells $G_{(3,1)}$, $G_{(3,2)}$, $G_{(3,3)}$ and $G_{(3,4)}$ over period "4" in the sustain process I of sub-field SF1, over period "2" in the sustain process I of each of sub-fields SF21-SF24 and over period "3" in the sustain process I of each of sub-fields SF31 and SF32. In this case, the four pixel cells $G_{(3,1)}$, $G_{(3,2)}$, $G_{(3,3)}$ and $G_{(3,4)}$ have a mean emission period of "4" in the sub-field SF1, a mean emission period of "2" in each of sub-fields SF21-SF24, and a mean emission period of "3" in each of sub-fields SF31 and SF32. This accordingly provides a visual perception at a luminance in a level corresponding to the sum "18" of sub-field-based mean emission period of within the 1-frame display period.

[Pixel Cells Belonging to the (4N)-th Display Line]

First, in the case the pixel data PD corresponding to the four pixel cells $G_{(4,1)}$, $G_{(4,2)}$, $G_{(4,3)}$, $G_{(4,4)}$ represents a luminance level "9", dither values "4", "5", "6", "7" are added respectively to and further line-offset data "3" is added to those thereby extracting the higher-order 3 bits of addition result.

Thereupon, dither-added pixel data $KD_{(4,1)}$, $KD_{(4,2)}$, $KD_{(4,3)}$, $KD_{(4,4)}$ is generated comprising the followings, as shown in FIG. 10.

$KD_{(4,1)}$=[100]
$KD_{(4,2)}$=[100]
$KD_{(4,3)}$=[100]
$KD_{(4,4)}$=[100]

Accordingly, the pixel cells $G_{(4,1)}$, $G_{(4,2)}$, $G_{(4,3)}$, $G_{(4,4)}$ are set to off-mode in the address process W1 of sub-field SF31 as shown in FIG. 5, according to the dither-added pixel data KD of [100]. Thus, emission is maintained on the pixel cells $G_{(4,1)}$, $G_{(4,2)}$, $G_{(4,3)}$ $G_{(4,4)}$ over period "4" in the sustain process I of sub-field SF1, over period "2" in the sustain process I of each of sub-fields SF21-SF24, and over period "3" in the sustain process I of sub-field SF31. In this case, the four pixels cells $G_{(4,1)}$, $G_{(4,2)}$, $G_{(4,3)}$, $G_{(4,4)}$ have a mean emission period of "4" in the sub-field SF1, a mean emission period of "2" in each of sub-fields SF21-SF24, and a mean emission period of "3" in sub-field SF31. This accordingly provides a visual perception at a luminance in a level corresponding to the sum "15" of sub-field-based mean emission periods of within the 1-frame display period.

Meanwhile, in the case the pixel data PD corresponding to four pixel cells $G_{(4,1)}$, $G_{(4,2)}$, $G_{(4,3)}$, $G_{(4,4)}$ represents a luminance level "10", dither values "4", "5", "6", "7" are added respectively to and further line-offset data "3" is added to those thereby extracting the higher-order 3 bits of the addition result. Thereupon, dither-added pixel data $KD_{(4,1)}$, $KD_{(4,2)}$, $KD_{(4,3)}$, $KD_{(4,4)}$ is generated comprising the followings, as shown in FIG. 10.

$KD_{(4,1)}$=[100]
$KD_{(4,2)}$=[100]
$KD_{(4,3)}$=[100]
$KD_{(4,4)}$=[101]

Accordingly, the pixel cells $G_{(4,1)}$, $G_{(4,2)}$ and $G_{(4,3)}$ are set to off-mode in the address process W1 of sub-field SF31 as shown in FIG. 5, according to the dither-added pixel data KD of [100]. Thus, emission is maintained on the pixel cells $G_{(4,1)}$, $G_{(4,2)}$ and $G_{(4,3)}$ over period "4" in the sustain process I of sub-field SF1, over period "2" in the sustain process I of each of sub-fields SF21-SF24 and over period "3" in the sustain process I of sub-field SF31. Meanwhile, the pixel cell $G_{(4,4)}$ is set to off-mode in the address process W1 of sub-field SF41 as shown in FIG. 5, according to the dither-added pixel data KD of [101]. Thus, emission is maintained on the pixel cell $G_{(4,4)}$ over period "4" in the sustain process I of sub-field SF1, over period "2" in the sustain process I of each of sub-fields SF21-SF24, over period "3" in the sustain process I of each of sub-fields SF31-SF34, and over period "4" in the sustain process I of sub-field SF41. In this case, the four pixel cells $G_{(4,1)}$, $G_{(4,2)}$, $G_{(4,3)}$, $G_{(4,4)}$ have a mean emission period of "4" in the sub-field SF1, a mean emission period of "2" in each of sub-fields SF21-SF24, a mean emission period of "3" in sub-field SF31, a mean emission period of "0.75" in each of sub-fields SF32-SF34, and a mean emission period of "1" in sub-field SF41. This accordingly provides a visual perception at a luminance in a level corresponding to the sum "18.25" of sub-field-based mean emission periods of within the 1-frame display period.

As described above, in the driving shown in FIGS. 5 and 6, in the case the video signal is representative of a luminance lower than a predetermined luminance level, what is called a driving-with-no-line-dithering (KD=[000], [001], [010]) is implemented wherein emission is caused on all the pixel cells in the same sub-field according to the video signal regardless of the display line to which those belong. Meanwhile, when representing a higher luminance, what is called a driving-with-line-dithering (KD=[011], [100], [101]) is implemented wherein emission is caused on the pixel cells based on adjacent four display lines a time according to the video signal. In this case, in the case the video signal represents a luminance lower than the predetermined luminance level, any one of pixel-cell emission driving (KD=[010]) and pixel-cell non-emission driving (KD =[000] or [001]) is implemented in every field within the sub-field group SG2 having successive four sub-fields SF21-SF24 as shown in FIG. 6. Meanwhile, in the case the video signal represents a luminance higher than the predetermined luminance level, the following driving is implemented within the sub-field group SG2 and in the sub-field groups SG3 and SG4 following SG2 and each having successive four sub-fields. Namely, pixel-cell emission driving (KD=[011], [100], [101]) is implemented in the successive sub-fields in the number corresponding to the luminance level represented by the video signal, in a series of sub-fields SF21-SF24, SF31-SF34 and SF41-SF44 belonging to the sub-field groups SG2-SG3.

Accordingly, in the sub-field group SG2 having sub-fields SF21-SF24, processing-with-no-line-dithering is to be performed when the video signal represents a luminance lower than the predetermined luminance level. When the video signal represents a luminance higher than the predetermined luminance level, processing-with-line-dithering is to be performed. Namely, the sub-field group SG2 is a level-distortion-correcting sub-field group to connect between the gray-scale level in a driving-with-no-line-dithering and the gray-scale level in a driving-with-line-dithering.

According to such driving, there is a difference "2" between the luminance expressed by a driving-with-no-line-dithering based on SF1 (luminance level "4") and the luminance expressed by a driving-with-no-line-dithering based on SF21-SF24 (luminance level "6" or "8"), on the pixel cells belonging to each display line. For this reason, the luminance difference between a gray-scale level expressing a lower luminance (with no line dithering) and a gray-scale level expressing a luminance higher than that gray-scale level (with line dithering) can be provided equal on the pixel cells belonging to each display line. This makes it possible to display a quality image reduced of display noise.

Incidentally, the embodiment explained the operation for line dithering in unit of adjacent four display lines, e.g. (4N)-th display line, (4N−1)-th display line, (4N -2)-th display line and (4N−3)-th display line. Alternatively, they may be in a plurality, i.e. six, eight or the greater, without limited to the four lines.

In this case, it is satisfactory to change the four sub-field SF21-SF24 into sub-fields SF21-SF2(M) in the number of M so that setting (on or off-mode) can be made for the pixel cells belonging to the followings, according to pixel data:

(M·N)-th display line in an address process to SF21, (M·N−1)-th display line in an address process to SF22, (M·N−2)-th display line in an address process to SF23, (M·N−M+1)-th display line in an address process to SF2(M).

Figure 11:
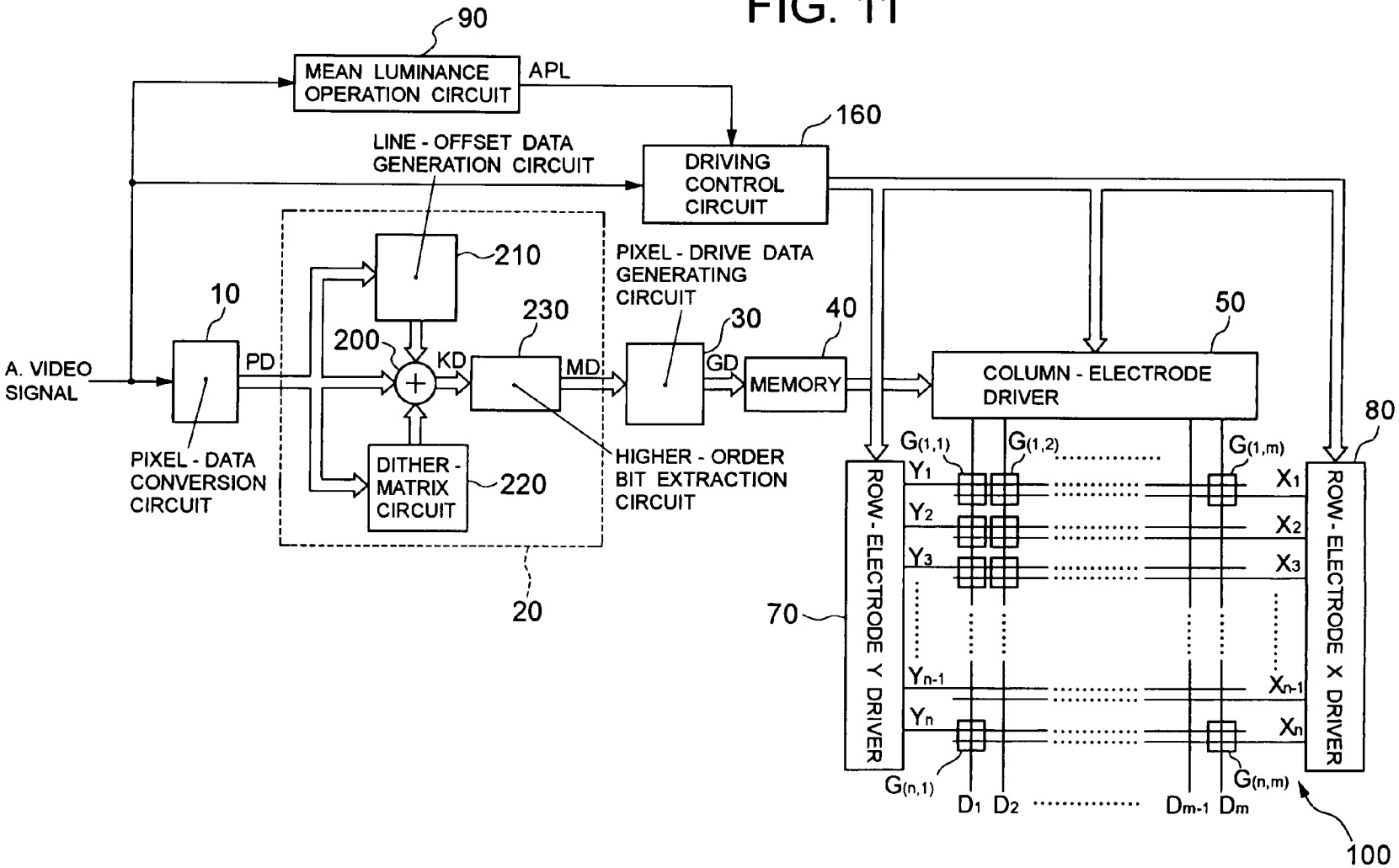
FIG. 11 is a figure showing another arrangement of a plasma display apparatus for driving a plasma display panel depending upon a display panel driving method according to the invention.

FIG. 11 is a diagram showing a schematic arrangement of a plasma display apparatus for driving a plasma display panel based on another method of driving according to the invention.

Note that the plasma display apparatus shown in FIG. 11 is an addition of a mean-luminance operation circuit 90 to the plasma display apparatus shown in FIG. 3 and wherein a drive control circuit 160 is employed in place of the drive control circuit 60. Accordingly, explanation is made below only on the operation of the mean-luminance operation circuit 90 and the control operation based on the drive control circuit 160.

The mean-luminance operation circuit 90 calculates a mean luminance level on each image frame (or each field) depending upon an input video signal, and supplies a mean luminance signal APL representative of a mean luminance level thereof to the drive control circuit 160.

Figure 12:
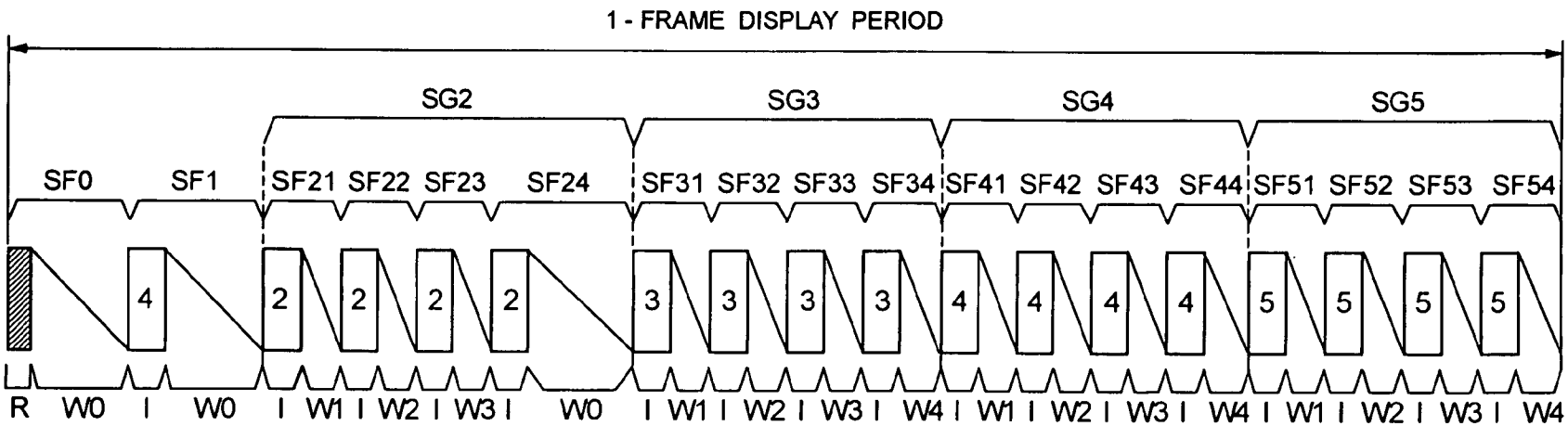
FIG. 12 is a figure showing a first emission-drive sequence for use in driving a PDP 100 in the plasma display apparatus shown in FIG. 11.

When the mean luminance level represented by the mean luminance signal APL is greater than a predetermined reference luminance level, the drive control circuit 160 supplies various timing signals for level-driving the PDP 100 to the column-electrode driver 50, the row-electrode Y driver 70 and the row-electrode X driver 80 respectively, according to the first emission-drive sequence as shown in FIG. 12. Meanwhile, when the mean luminance level represented by the mean luminance signal APL is smaller than the predetermined reference luminance level, the drive control circuit 160 supplies various timing signals for level-driving the PDP 100 to the column-electrode driver 50, the row-electrode Y driver 70 and the row-electrode X driver 80 respectively, according to the second emission-drive sequence as shown in FIG. 13.

Figure 13:
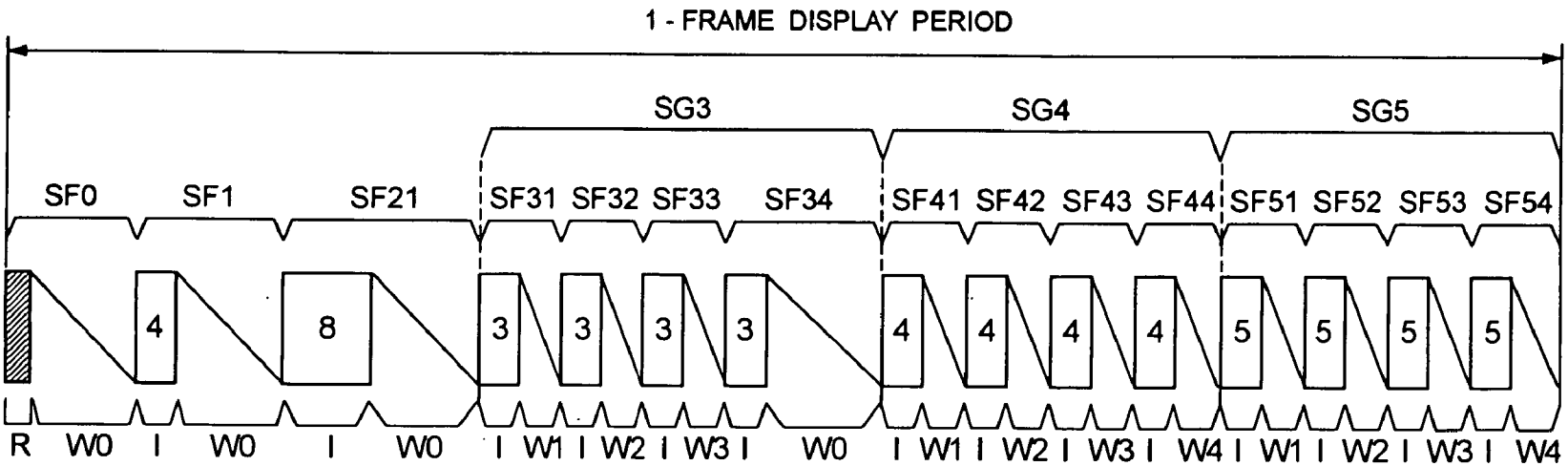
FIG. 13 is a figure showing a second emission-drive sequence for use in driving the PDP 100 in the plasma display apparatus shown in FIG. 11.

Namely, the panel drive section (drive control circuit 160, column-electrode driver 50, row-electrode Y driver 70 and row-electrode X driver 80) performs a level-driving to the PDP 100 according to the first emission-drive sequence shown in FIG. 12 in the case the input video signal is high in its mean luminance level, and according to the second emission-drive sequence shown in FIG. 13 in the case it is low.

Now explanations are made separately on the driving according to the first emission-drive sequence as shown in FIG. 12 and the driving according to the second emission-drive sequence as shown in FIG. 13.

(1) Driving According to First Emission Drive Sequence

At first, the panel-drive section, in the head sub-field SF0, sequentially performs a reset process R for initializing all the pixel cells on the PDP 100 into on-mode, and an address process W0 for selectively transiting the pixel cell to off-mode according to pixel-driving data bits.

Then, the panel-drive section, in sub-field SF1, sequentially performs a sustain process I for maintaining emission only on the on-mode pixel cells over period "4", and the address process W0.

Then, the panel-drive section, in sub-field SF21, sequentially performs a sustain process I for maintaining emission only on the on-mode pixel cells over period "2", and an address process W1 for selectively transiting to off-mode the pixel cells belonging to the (4N)-th display line according to pixel-drive data bits. Then, the panel-drive section, in sub-field SF22, sequentially performs a sustain process I for maintaining emission only on the on-mode pixel cells over period "2", and an address process W2 for selectively transiting to off-mode the pixel cells belonging to the (4N−1)-th display line according to pixel-drive data bits. Then, the panel-drive section, in sub-field SF23, sequentially performs a sustain process I for maintaining emission only on the on-mode pixel cells over period "2", and an address process W3 for selectively transiting to off-mode the pixel cells belonging to the (4N−2)-th display line according to pixel-drive data bits. Then, the panel-drive section, in sub-field SF24, sequentially performs a sustain process I for maintaining emission only on the on-mode pixel cells over period "2", and an address process W0 for selectively transiting to off-mode the pixel cells of among all the pixel cells according to pixel-drive data bits.

Then, the panel-drive section, in sub-field SF31, sequentially performs a sustain process I for maintaining emission only on the on-mode pixel cells over period "3", and an address process W1 for selectively transiting to off-mode the pixel cells belonging to the (4N)-th display line according to pixel-drive data bits. Then, the panel-drive section, in sub-field SF32, sequentially performs a sustain process I for maintaining emission only on the on-mode pixel cells over period "3", and an address process W2 for selectively transiting to off-mode the pixel cells belonging to the (4N−1)-th display line according to pixel-drive data bits. Then, the panel-drive section, in sub-field SF33, sequentially performs a sustain process I for maintaining emission only on the on-mode pixel cells over period "3", and an address process W3 for selectively transiting to off-mode the pixel cells belonging to the (4N−2)-th display line according to pixel-drive data bits. Then, the panel-drive section, in sub-field SF34, sequentially performs a sustain process I for maintaining emission only on the on-mode pixel cells over period "3", and an address process W4 for selectively transiting to off-mode the pixel cells belonging to the (4N−3)-th display line according to pixel-drive data bits.

Then, the panel-drive section, in sub-field SF41, sequentially performs a sustain process I for maintaining emission only on the on-mode pixel cells over period "4", and an address process W1 for selectively transiting to off-mode the pixel cells belonging to the (4N)-th display line according to pixel-drive data bits. Then, the panel-drive section, in sub-field SF42, sequentially performs a sustain process I for maintaining emission only on the on-mode pixel cells over period "4", and an address process W2 for selectively transiting to off-mode the pixel cells belonging to the (4N−1)-th display line according to pixel-drive data bits. Then, the panel-drive section, in sub-field SF43, sequentially performs a sustain process I for maintaining emission only on the on-mode pixel cells over period "4", and an address process W3 for selectively transiting to off-mode the pixel cells belonging to the (4N−2)-th display line according to pixel-drive data bits. Then, the panel-drive section, in sub-field SF44, sequentially performs a sustain process I for maintaining emission only on the on-mode pixel cells over period "4", and an address process W4 for selectively transiting to off-mode the pixel cells belonging to the (4N−3)-th display line according to pixel-drive data bits.

Then, the panel-drive section, in sub-field SF51, sequentially performs a sustain process I for maintaining emission only on the on-mode pixel cells over period "5", and an address process W1 for selectively transiting to off-mode the pixel cells belonging to the (4N)-th display line according to pixel-drive data bits. Then, the panel-drive section, in sub-field SF52, sequentially performs a sustain process I for maintaining emission only on the on-mode pixel cells over period "5", and an address process W2 for selectively transiting to off-mode the pixel cells belonging to the (4N−1)-th display line according to pixel-drive data bits. Then, the panel-drive section, in sub-field SF53, sequentially performs a sustain process I for maintaining emission only on the on-mode pixel cells over period "5", and an address process W3 for selectively transiting to off-mode the pixel cells belonging to the (4N−2)-th display line according to pixel-drive data bits. Then, the panel-drive section, in sub-field SF54, sequentially performs a sustain process I for maintaining emission only on the on-mode pixel cells over period "5", and an address process W4 for selectively transiting to off-mode the pixel cells belonging to the (4N−3)-th display line according to pixel-drive data bits.

Here, in the second emission-drive sequence shown in FIG. 12, there is an opportunity the pixel cell is allowed to transit from off-mode to on-mode only in the reset process R of the head sub-field SF0 of among the sub-fields of within the 1-frame display period or unit display period. Namely, in case the pixel cell is set in off-mode in an address process (W0, W1, W2, W3 or W4) of one of sub-fields SF0, SF1, SF21-

SF24, SF31-SF34, SF41-SF44 and SF51-SF54, this pixel cell cannot be returned to on-mode in the subsequent sub-field. In this case, when the pixel-drive data bits are at logical level 1, the pixel cell is to be set to off-mode in an address process (W0, W1, W2, W3 or W4) of the corresponding sub-field to the place of bit thereof.

Accordingly, the pixel cells are to perform a sustain-discharge emission (shown at the white circle) in the sustain process I of each of sub-fields in succession from the beginning, until off-mode is set in an address process of a sub-field shown by the black circle of FIG. 14. In this case, visual perception is available at the intermediate luminance in a level corresponding to the total emission period of within 1-frame display period due to the sustain-discharge emission.

Namely, the panel-drive section is to implement driving according to an emission pattern, as shown in FIG. 14, wherein the total emission period of within 1-frame display period is different depending upon the dither-added pixel data KD representing the luminance represented by the input video signal in 7 levels.

For example, in the case the dither-added pixel data KD is at [000] representing the lowest luminance, the panel-drive section sets the pixel cell to off-mode in the address process W0 of the head sub-field SF0, as shown by the black circle. In this case, because no sustain-discharge emission is caused at all throughout the 1-frame display period, expression is at the lowest luminance level 0.

Meanwhile, when the dither-added pixel data KD is at [001] representing a luminance one-level higher than [000], the panel-drive section sets the pixel cell to off-mode only in the address process W0 of sub-field SF1, as shown by the black circle. In this case, because sustain-discharge emission is caused over period "4" only in the sustain process I of sub-field SF1 throughout the 1-frame display period, expression is at the luminance in a level corresponding to the period "4".

Meanwhile, when the dither-added pixel data KD is at [010] representing a luminance one-level higher than [001], the panel-drive section sets the pixel cell to off-mode only in the address process W0 of sub-field SF24, as shown by the black circle. In this case, because sustain-discharge emission is caused over period "4" in the sustain process I of sub-field SF1 and over period "2" in the sustain process I of each of sub-fields SF21-SF24, expression is at the luminance in a level corresponding to the total emission period "12".

Incidentally, when the dither-added pixel data KD represents a luminance higher than [011], the panel-drive section performs an emission driving having emission patterns of within 1-frame display period different according to the dither-added pixel data KD, on the pixel cells belonging to each of the four display lines adjacent vertically of the screen, i.e. based on the following:

pixel cells belonging to the (4N−3)-th display line,
pixel cells belonging to the (4N−2)-th display line,
pixel cells belonging to the (4N−1)-th display line, and
pixel cells belonging to the (4N)-th display line.

For example, when the dither-added pixel data KD is at [011], the panel-drive section sets to off-mode the pixel cells belonging to the (4N)-th display line, i.e. the fourth, eighth, twelfth, . . . , n-th display lines, only in the address process W1 of sub-field SF21, as shown by the black circle. In this case, because sustain-discharge emission is caused on the pixel cell belonging to the (4N)-th display line only in the sustain process I of each of sub-fields SF1 and SF21, expression is at the luminance in a level corresponding to the total emission period "6". Meanwhile, for the pixel cells belonging to the (4N−1)-th display line, i.e. the third, seventh, eleventh, . . . , (n−1)-th display lines, the panel-drive section sets the pixel cells to off-mode only in the address process W2 of sub-field SF22. In this case, because sustain-discharge emission is caused on the pixel cell belonging to the (4N−1)-th display line only in the sustain process I of each of sub-fields SF1, SF21 and SF22, expression is at the luminance in a level corresponding to the total emission period "8". Meanwhile, for the pixel cells belonging to the (4N−2)-th display line, i.e. the second, sixth, tenth, . . . , (n−2)-th display lines, the panel-drive section sets the pixel cells to off-mode only in the address process W3 of sub-field SF23. In this case, because sustain-discharge emission is caused on the pixel cells belonging to the (4N−2)-th display line only in the sustain process I of each of sub-fields SF1, SF21-SF23, expression is at the luminance in a level corresponding to the total emission period "10". Meanwhile, for the pixel cells belonging to the (4N−3)-th display line, i.e. the first, fifth, ninth, . . . , (n−3)-th display lines, the panel-drive section sets the pixel cells to off-mode only in the address process W0 of sub-field SF24. In this case, because sustain-discharge emission is caused on the pixel cells belonging to the (4N−3)-th display line only in the sustain process I of each of sub-fields SF1, SF21-SF24, expression is at the luminance in a level corresponding to the total emission period "12".

Namely, emission is caused at luminance levels respectively of

"6" on the pixel cells belonging to the (4N)-th display line,
"8" on the pixel cells belonging to the (4N−1)-th display line,
"10" on the pixel cells belonging to the (4N−2)-th display line, and
"12" on the pixel cells belonging to the (4N−3)-th display line, according to the dither-added pixel data KD of [011].

Similarly, emission is caused at luminance levels respectively of

"15" on the pixel cells belonging to the (4N)-th display line,
"18" on the pixel cells belonging to the (4N−1)-th display line,
"21" on the pixel cells belonging to the (4N−2)-th display line, and
"24" on the pixel cells belonging to the (4N−3)-th display line, according to the dither-added pixel data KD of [100] representative of a luminance one-level higher than [011].

Meanwhile, emission is caused at luminance levels respectively of

"28" on the pixel cells belonging to the (4N)-th display line,
"32" on the pixel cells belonging to the (4N−1)-th display line,
"36" on the pixel cells belonging to the (4N−2)-th display line, and
"40" on the pixel cells belonging to the (4N−3)-th display line, according to the dither-added pixel data KD of [101] representative of a luminance one-level higher than [100].

Then, emission is caused at luminance levels respectively of

"45" on the pixel cells belonging to the (4N)-th display line,
"50" on the pixel cells belonging to the (4N−1)-th display line,
"55" on the pixel cells belonging to the (4N−2)-th display line, and
"60" on the pixel cells belonging to the (4N−3)-th display line, according to the dither-added pixel data KD of [110] representative of the highest luminance level.

In brief, in the driving according to the first emission-drive sequence, line dithering as in the foregoing is effected limitedly in the case the dither-added pixel data KD represents a luminance higher than [011]. In this case, both of driving-with-no-line-dithering (KD=[010]) and driving-with-line-dithering (KD=[011]) are carried out in the sub-fields SF21-SF24 following the sub-field SF1 (with no line dithering) for emission of low luminance components and serving for emission at a luminance one-level higher than SF1.

Here, the dither-added pixel data KD is the one obtained by extracting the higher-order 3 bits from an 5-bit addition result obtained by adding line offset data and dither value as noted before to the pixel data PD corresponding to the input video signal. Accordingly, even where the pixel data PD corresponding to the respective 16 pixels (pixel cells) having 4×4 pixels adjacent vertically and horizontally of the screen represents a luminance equal in level at all, emission patterns are not necessarily identical within the 1-frame display period as to the pixels. In this case, visual perception is available at the luminance corresponding in level to the total period (within the 1-frame display period) of sub-field-based mean emission periods as to the adjacent four pixels.

FIGS. 15 to 18 are figures showing sub-field-based mean emission periods for emissions on the four pixel cells according to the dither-added pixel data KD, by excerpting four pixel cells mutually arranged adjacent on each of the display lines. In this case, FIG. 15 shows a figure showing the dither-added pixel data $KD_{(1,1)}$, $KD_{(1,2)}$, $KD_{(1,3)}$, $KD_{(1,4)}$ corresponding respectively, for example, to the pixel cells $G_{(1,1)}$, $G_{(1,2)}$, $G_{(1,3)}$, $G_{(1,4)}$ arranged mutually adjacent on the (4N−3)-th display line, and the mean emission periods in the respective sub-fields for emissions on those pixel cells $G_{(1,1)}$, $G_{(1,2)}$, $G_{(1,3)}$, $G_{(1,4)}$. Meanwhile, FIG. 16 shows a figure showing the dither-added pixel data $KD_{(2,1)}$, $KD_{(2,2)}$, $KD_{(2,3)}$, $KD_{(2,4)}$ corresponding respectively, for example, to the pixel cells $G_{(2,1)}$, $G_{(2,2)}$, $G_{(2,3)}$, $G_{(2,4)}$ belonging to the (4N−2)-th display line, and the mean emission periods in the respective sub-fields for emissions on the four pixel cells $G_{(2,1)}$, $G_{(2,2)}$, $G_{(2,3)}$, $G_{(2,4)}$. FIG. 17 shows a figure showing the dither-added pixel data $KD_{(3,1)}$, $KD_{(3,2)}$, $KD_{(3,3)}$, $KD_{(3,4)}$ corresponding respectively, for example, to the pixel cells $G_{(3,1)}$, $G_{(3,2)}$, $G_{(3,3)}$, $G_{(3,4)}$ belonging to the (4N−1)-th display line, and the mean emission periods in the respective sub-fields for emissions on those four pixel cells $G_{(3,1)}$, $G_{(3,2)}$, $G_{(3,3)}$, $G_{(3,4)}$. FIG. 18 shows a figure showing the dither-added pixel data $KD_{(4,1)}$, $KD_{(4,2)}$, $KD_{(4,3)}$, $KD_{(4,4)}$ corresponding respectively, for example, to the pixel cells $G_{(4,1)}$, $G_{(4,2)}$, $G_{(4,3)}$, $G_{(4,4)}$ belonging to the (4N)-th display line, and the mean emission periods in the respective sub-fields for emissions on those four pixel cells $G_{(4,1)}$, $G_{(4,2)}$, $G_{(4,3)}$, $G_{(4,4)}$.

As described above, in the driving in accordance with the first emission-drive sequence shown in FIG. 12, what is called a driving-with-no-line-dithering (KD=[000], [001], [010]) is carried out wherein emission is caused on all the pixel cells in the same sub-field according to the video signal as shown in FIG. 14, when the dither-added pixel data KD represents a luminance lower than [011]. In this case, within the sub-field group SG2 having successive four sub-fields SF21-SF24 as shown in FIG. 12, any one is effected of driving for turning on all the pixel cells in all the sub-fields (KD=[010]) and driving for turning off those (KD=[000] or [001]) as shown in FIG. 14. Meanwhile, when the dither-added pixel data KD represents a luminance higher than [011], what is called a driving-with-line-dithering (KD=[011], [100], [101], [110]) is carried out wherein the sub-fields the pixel cells on the display line are put in an emission state emission are different in the number between the adjacent four display lines as shown in FIG. 14. In this case, in the sub-field group SG2, any one is carried out of driving for turning on the pixel cells in all the sub-fields (KD=[100]-[110]) and driving in which the sub-fields the pixel cells on the display line are put in an emission state are different in the number between the adjacent four display lines (KD=[011]), as shown in FIG. 14. Namely, the sub-field group SG2 having sub-fields SF21-SF24 is a level-distortion-correcting sub-field group to connect between the gray-scale level in a driving-with-no-line-dithering and the gray-scale level in a driving-with-line-dithering.

According to the driving as above, the luminance expressed by a driving-with-no-line-dithering based on SF1 (luminance level "4") and the luminance expressed by a driving-with-no-line-dithering due to SF21-SF24 (luminance level "6" or "8") have a luminance difference of "2" on the pixel cells belonging to each of the display lines as shown in FIGS. 15 to 18. Accordingly, the luminance difference between a gray-scale level expressing a low luminance (with no line dithering) and a gray-scale level expressing a luminance higher than that gray-scale level (with line dithering) can be provided equal on the pixel cells belonging to each of the display lines. This makes it possible to make an image display with quality reduced of display noise.

(2) Driving According to Second Emission Drive Sequence

The second emission-drive sequence shown in FIG. 13 is similar to the first emission-drive sequence shown in FIG. 12 except in that a single sub-field SF2 is to be executed in place of the sub-fields SF21-SF24 shown in FIG. 12 and, in the sub-field SF34, an address process W0 is to be executed in place of the address process W4. In this case, in the sub-field SF2, the panel-drive section sequentially carries out a sustain process I for maintaining the emission only on the on-mode pixel cells over period "8" and an address process W0 for selectively transiting the pixel cells out of all the pixel cells to off-mode according to pixel-drive data bits.

According to the second emission-drive sequence, sustain-discharge emissions (shown by the white circles) are caused on the pixel cells in the sustain process I of each of the sub-fields in succession from the beginning before a setting to off-mode in the address process of sub-field shown by the black circle in FIG. 19. In this case, visual perception is available at the intermediate luminance corresponding to the total emission period of within the 1-frame display period based on the discharge emission.

Namely, the panel-drive section implements driving according to emission patterns different in total emission period within the 1-frame display period as shown in FIG. 19, according to the dither-added pixel data KD representing a luminance indicated by the input video signal in 7 levels.

For example, in the case the dither-added pixel data KD is at [000] representative of the lowest luminance level, the panel-drive section sets the pixel cell to off-mode in the address process W0 of the head sub-field SF0 as shown by the black circle. In this case, the lowest luminance level 0 is to be expressed because of no sustain-discharge emission caused at all in the sustain process I throughout the 1-frame display period.

Meanwhile, in the case the dither-added pixel data KD is at [001] representative of a luminance one-level higher than the above [000], the panel-drive section sets the pixel cell to off-mode only in the address process W0 of sub-field SF1 as shown by the black circle. In this case, the luminance level is to be expressed corresponding to the period "4" because sustained emission is caused over period "4" only in the sustain process I of sub-field SF1 throughout the 1-frame display period.

Meanwhile, in the case the dither-added pixel data KD is at [010] representative of a luminance one-level higher than the above [001], the panel-drive section sets the pixel cell to off-mode only in the address process W0 of sub-field SF2 as shown by the black circle. In this case, the luminance level is to be expressed corresponding to the total emission period "12" because sustained discharge emission is caused over period "8" in the sustain process I of each of sub-field SF2.

Meanwhile, in the case the dither-added pixel data KD is at [011] representative of a luminance one-level higher than the above [010], the panel-drive section sets the pixel cell to off-mode only in the address process W0 of sub-field SF34 as shown by the black circle. In this case, the luminance level is to be expressed corresponding to the total emission period "24" because sustained discharge emission is caused over period "4" in the sustain processes I of sub-field SF1, over period "8" in the sustain process I of sub-field SF2 and over period "3" in the sustain processes I of each of sub-field SF31-SF34.

Incidentally, in the case the dither-added pixel data KD represents a luminance higher than [100], the panel-drive section carries out what is called a line dithering, i.e. driving with emission patterns made different within the 1-frame display period according to the dither-added pixel data KD, to the pixel cells belonging to each of the four display lines adjacent vertically of the screen, i.e. to each of the followings:

pixel cells belonging to the (4N−3)-th display line, pixel cells belonging to the (4N−2)-th display line, pixel cells belonging to the (4N−1)-th display line and pixel cells belonging to the (4N)-th display line.

For example, in the case the dither-added pixel data KD is at [100], the panel-drive section sets to off-mode the pixel cells belonging to the (4N)-th display line, i.e. the fourth, eighth, twelfth, . . . , and n-th display lines, only in the address process W1 of sub-field SF31, as shown by the black circle. In this case, the pixel cells belonging to the (4N)-th display line, because sustained discharge emission is caused only in the sustain process I of each of sub-fields SF1, SF2 and SF31, are expressed at the luminance level corresponding to the total emission period "15". Meanwhile, the panel-drive section sets to off-mode the pixel cells belonging to the (4N−1)-th display line, i.e. the third, seventh, eleventh, . . . , and (n−1)-th display lines, only in the address process W2 of sub-field SF32. In this case, the pixel cells belonging to the (4N−1)-th display line, because sustained discharge emission is caused only in the sustain process I of each of sub-fields SF1, SF2, SF31 and SF32, are expressed at the luminance level corresponding to the total emission period "18" thereof. Meanwhile, the panel-drive section sets to off-mode the pixel cells belonging to the (4N−2)-th display line, i.e. the second, sixth, tenth, . . . , and (n−2)-th display lines, only in the address process W3 of sub-field SF33. In this case, the pixel cells belonging to the (4N−2)-th display line, because sustained discharge emission is caused only in the sustain processes I of each of sub-fields SF1, SF2, SF31-SF33, are expressed at the luminance level corresponding to the total emission period "21" thereof. Meanwhile, the panel-drive section sets to off-mode the pixel cells belonging to the (4N−3)-th display line, i.e. the first, fifth, ninth, . . . , and (n−3)-th display lines, only in the address process W0 of sub-field SF34. In this case, the pixel cells belonging to the (4N−3)-th display line, because sustained discharge emission is caused only in the sustain process I of each of sub-fields SF1, SF2, SF31-SF34, are expressed at the luminance level corresponding to the total emission period "24" thereof.

Namely, emission is caused at respective luminance levels of:

"15" on the pixel cell belonging to the (4N)-th display line,

"18" on the pixel cell belonging to the (4N−1)-th display line,

"21" on the pixel cell belonging to the (4N−2)-th display line, and

"24" on the pixel cell belonging to the (4N−3)-th display line, according to the dither-added pixel data KD of [100].

Similarly, emission is caused at respective luminance levels of:

"28" on the pixel cell belonging to the (4N)-th display line,

"32" on the pixel cell belonging to the (4N−1)-th display line,

"36" on the pixel cell belonging to the (4N−2)-th display line, and

"40" on the pixel cell belonging to the (4N−3)-th display line, according to the dither-added pixel data KD of [101] representative of a luminance one-level higher than [100].

Furthermore, emission is caused at respective luminance levels of:

"45" on the pixel cell belonging to the (4N)-th display line,

"50" on the pixel cell belonging to the (4N−1)-th display line,

"55" on the pixel cell belonging to the (4N−2)-th display line, and

"60" on the pixel cell belonging to the (4N−3)-th display line, according to the dither-added pixel data KD of [110] representative of the highest luminance level.

In brief, in the driving according to the second emission-drive sequence shown in FIG. 13, line dithering as noted before is carried out in the case the dither-added pixel data KD represents a luminance higher than [100]. In this case, both of driving with no line dithering (KD=[011]) and driving with line dithering (KD=[100]) are performed in the sub-field group SG3 following the sub-fields SF1 and SF2 (both having no dithering) for emission of low-luminance components and serving for emission at a luminance one-level higher than SF2.

FIGS. 20 to 23 are figures showing sub-field-based mean emission periods based on emissions on the four pixel cells according to the dither-added pixel data KD, by excerpting four pixel cells mutually arranged adjacent on each of the display lines. In this case, FIG. 20 shows a figure showing the dither-added pixel data KD(1, 1), $KD_{(1, 2)}$, $KD_{(1, 3)}$, $KD_{(1, 4)}$ corresponding respectively, for example, to the pixel cells $G_{(1, 1)}$, $G_{(1, 2)}$, $G_{(1, 3)}$, $G_{(1, 4)}$ arranged mutually adjacent on the (4N−3)-th display line, and the mean emission periods in the respective sub-fields based on emissions on those pixel cells $G_{(1, 1)}$, $G_{(1, 2)}$, $G_{(1, 3)}$, $G_{(1, 4)}$. Meanwhile, FIG. 21 shows a figure showing the dither-added pixel data $KD_{(2, 1)}$, $KD_{(2, 2)}$, $KD_{(2, 3)}$, $KD_{(2, 4)}$ corresponding respectively, for example, to the pixel cells $G_{(2, 1)}$, $G_{(2, 2)}$, $G_{(2, 3)}$, $G_{(2, 4)}$ belonging to the (4N−2)-th display line, and the mean emission periods in the respective sub-fields based on emission on those pixel cells $G_{(2, 1)}$, $G_{(2, 2)}$, $G_{(2, 3)}$, $G_{(2, 4)}$. FIG. 22 shows a figure showing the dither-added pixel data $KD_{(3, 1)}$, $KD_{(3, 2)}$, $KD_{(3, 3)}$, $KD_{(3, 4)}$ corresponding respectively, for example, to the pixel cells $G_{(3, 1)}$, $G_{(3, 2)}$, $G_{(3, 3)}$, $G_{(3, 4)}$ belonging to the (4N−1)-th display line, and the mean emission periods in the respective sub-fields based on emissions on those pixel cells $G_{(3, 1)}$, $G_{(3, 2)}$, $G_{(3, 3)}$, $G_{(3, 4)}$. FIG. 23 shows a figure showing the dither-added pixel data $KD_{(4, 1)}$, $KD_{(4, 2)}$, $KD_{(4, 3)}$, $KD_{(4, 4)}$ corresponding respectively, for example, to the pixel cells $G_{(4, 1)}$, $G_{(4, 2)}$, $G_{(4, 3)}$, $G_{(4, 4)}$ belonging to the (4N)-th display line, and the mean emission periods in the respective sub-fields based on emissions on those pixel cells $G_{(4, 1)}$, $G_{(4, 2)}$, $G_{(4, 3)}$, $G_{(4, 4)}$.

In this manner, in the driving in accordance with the second emission-drive sequence, what is called a driving-with-no-line-dithering (KD=[000], [001], [010], [011]) is carried out when the dither-added pixel data KD represents a luminance lower than [100] as shown in FIG. 19, wherein emission is caused on the pixel cells in the same sub-field regardless of the display line belonged to. In this case, within the sub-field group SG3 having successive four sub-fields SF31-SF34 as shown in FIG. 13, any one is effected of driving for turning on the pixel cells regardless of the display line to which those belong (KD=[010]) and driving for turning off those (KD=[000], [001] or [010]), as shown in FIG. 19. Meanwhile, when the dither-added pixel data KD represents a luminance higher than [100], what is called a driving-with-line-dithering (KD=[100], [101], [110]) is carried out wherein the sub-fields the pixel cells on the display line are put in an emission state are different in the number between the adjacent four display lines as shown in FIG. 19. In this case, in the sub-field group SG3, any one is effected of driving for turning on the pixel cells in every sub-field (KD=[101], [110]) and driving in which the sub-fields the pixel cells on the display line are put in an emission state are different in the number between the adjacent four display lines (KD=[100]), as shown in FIG. 14. Namely, the sub-field group SG3 having sub-fields SF31-SF34 is a level-distortion-correcting sub-field group to connect between the gray-scale level in a driving-with-no-line-dithering and the gray-scale level in a driving-with-line-dithering.

According to the driving, the luminance expressed by a driving-with-no-line-dithering based on SF1 and SF2 (luminance level "12") and the luminance expressed by a driving-with-no-line-dithering based on SF31-SF34 (luminance level "15" or "18") have a luminance difference of "3" on the pixel cells belonging to each of the display lines as shown in FIGS. 20 to 23. Accordingly, the luminance difference between a gray-scale level expressing a low luminance (with no line dithering) and a gray-scale level expressing a luminance higher than that gray-scale level (with line dithering) can be provided equal on the pixel cells belonging to each of the display lines. This makes it possible to make an image display with quality reduced of display noise.

As described above, the plasma display apparatus shown in FIG. 11 carries out driving as in FIGS. 14 to 18 (hereinafter, referred to as a first line dither driving) to the PDP 100 according to the first emission drive sequence shown in FIG. 12, when the input video signal has a mean luminance level higher than a predetermined reference luminance level. Meanwhile, when the input video signal has a mean luminance level lower than a predetermined reference luminance level, driving as in FIGS. 19 to 23 (hereinafter, referred to as a second line dither driving) is carried out to the PDP 100 according to the second emission drive sequence shown in FIG. 13.

In this case, in the first line dither driving, the sub-field group SG2 having sub-fields SF21-SF24 is a level-distortion-correcting sub-field group to connect between the gray-scale level in a driving-with-no-line-dithering and the gray-scale level in a driving-with-line-dithering. Meanwhile, in the second line dither driving, the sub-field group SG3 having sub-fields SF31-SF34 serving for display at a luminance higher than sub-field group SG2 is a level-distortion-correcting sub-field group to connect between the gray-scale level in a driving-with-no-line-dithering and the gray-scale level of upon a driving-with-line-dithering as shown in FIG. 19.

Here, in the plasma display apparatus, when the input video signal has a mean luminance level higher than the predetermined luminance level as compared to the case of the lower, control is effected for reducing the emission-sustaining period for assignment to each of sub-fields in order to suppress power consumption. In this case, in the plasma display device, sustain discharge is repeated every sub-field for the pixel cells by repeatedly applying a sustain pulse to the pixel cells over the emission-sustaining period in the sustain process of the sub-field, thereby maintaining the emission state based on such discharge. Accordingly, in case control is made for the sub-field group SG2 assigned with a shorter emission-sustaining period to have a further short emission-sustaining period, there is a possible case that the sub-field group SG2 is not to be architected with four sub-fields SF21-SF24. For example, when the input video signal has a mean luminance level higher than a predetermined luminance level, control is made to reduce from "8" down to "3" the emission-sustaining period for assignment to the sub-field group SG2. In this case, in case once application of sustain pulse corresponds to an emission-sustaining period "1", the number of application times of sustain pulse results in "3" corresponding to an emission-sustaining period "3" as in the above. However, it is impossible to assign it divisionally to the four sub-fields SF21-SF24.

For this reason, the plasma display apparatus shown in FIG. 11 is adapted to change the level-distortion-correcting sub-field group, to connect between the gray-scale level in a driving-with-no-line-dithering and the gray-scale level in a driving-with-line-dithering, into a sub-field group SG3 for higher luminance display than SG2 when the input video signal is high in its mean luminance level. In the sub-field group SG3, because its emission-sustaining period assigned is longer as compared to that of SG2, the number of sustain pulse applications is greater correspondingly. Accordingly, even where reduced is the emission-sustaining period assigned to the sub-field group SG3, the number of times of sustain pulse applications corresponding to the emission-sustaining period can be divided into four and assigned to the four sub-fields SF31-SF34 constituting the sub-field group SG3.

This application is based on Japanese Patent Application No. 2005-073009 which is hereby incorporated by reference.

What is claimed is:

1. A display panel driving method of gray-level-driving a display panel, having a plurality of pixel cells as pixels arranged on each of display lines, every one of a plurality of sub-fields of a frame display period according to pixel data based on a video signal and corresponding to the pixels, comprising the steps of:

causing a state of the pixel cells to transfer from one state into another state of on and off modes only within one of the sub-fields of the frame display period according to the pixel data, to maintain emissions only on the on-mode pixel cells in each of the sub-fields a number of times assigned to the sub-field; wherein executing a first process for making the sub-field different between display lines adjacent in the number of M, for causing the state of the pixel cells to transfer from the one state into the other state, in a particular sub-field group having sub-fields in number of M (M: integer of 2 or greater) arranged successive within the frame display period and in a subsequent sub-field group among sub-field groups subsequent to the particular sub-field group; and within the particular sub-field group, executing a second process for causing the state of the pixel cells to transfer from the one state into the other state only within a predetermined one of the sub-fields of the particular sub-field group when a gray-level represented by said pixel data is equal to a predetermined level, and executing the first process when the gray-level represented by said pixel data is one step higher that said predetermined level.

2. A display panel driving method according to claim 1, wherein within the particular sub-field group is executed the second process when a luminance level represented by the video signal is at a predetermined luminance level, and the first process when the luminance level represented by the video signal is at a luminance one level higher than the predetermined luminance.

3. A display panel driving method according to claim 2, wherein, when the luminance level represented by the video signal is higher than the predetermined luminance level, emission is maintained on the pixel cells in each of successive sub-fields in number corresponding to a luminance level represented by the video signal, of among the sub-fields belonging to the head sub-field, particular sub-field and subsequent sub-field groups.

4. A display panel driving method according to claim 2, wherein, when the luminance represented by the video signal is one-level higher than the predetermined luminance, the sub-fields for maintaining successively the emissions on the pixel cells within the particular sub-field group are different in number between the display lines adjacent in number of M, while, when the luminance represented by the video signal is equal to or lower in level than the predetermined luminance, the sub-fields for maintaining successively the emissions on the pixel cells within the particular sub-field group are equal in number between the display lines adjacent in number of M.

5. A display panel driving method according to claim 2, wherein, when the luminance represented by the video signal is equal to or lower in level than the predetermined luminance, the pixel cells are set uniformly to one of on and off modes in every sub-field of within the particular sub-field group, while, when the luminance represented by the video signal is greater in level than the predetermined luminance, the pixel cells are set to on mode in each of the successive sub-fields in a number suited for the luminance of among a series of sub-fields belonging to the particular sub-field and subsequent sub-field groups.

6. A display panel driving method according to claim 2, wherein, in the sub-fields of within the particular sub-field and subsequent sub-field groups, sequentially executed are a sustain process for maintaining the emissions only on the pixel cells in on mode over a period of emission assigned to the sub-fields and an address process for setting the pixel cells to one state of on and off modes according to the pixel data.

7. A display panel driving method according to claim 2, wherein the second process is executed only in a last one of the sub-fields of the particular sub-field group.

8. A display panel driving method according to claim 1, wherein the particular sub-field group is changed in position within the frame display period according to a total number of times of emissions assigned to the sub-fields of the frame display period.

9. A display panel driving method according to claim 8, wherein a head sub-field group having a plurality of mutually adjacent sub-fields including a head sub-field is arranged immediately preceding the particular sub-field group within the frame display period, the sub-fields of the head sub-field group being greater in number when the total number is smaller than a predetermined value as compared to a case greater.

10. A display panel driving method according to claim 1, wherein, in the sub-fields excluding the head sub-field within the frame display period, sequentially executed are a sustain process for maintaining the emissions only on the pixel cells in on mode in a number of times assigned to the sub-fields and an address process for setting the pixel cells to one state of on and off modes according to the pixel data.

11. A display panel driving method according to claim 10, wherein all the pixel cells are initialized to on mode only in the head sub-field of the frame display period, to cause the pixel cells to transfer from on mode state to off mode state only in one of the sub-fields.

12. A display panel driving method according to claim 1, wherein, when the luminance represented by the video signal is at the predetermined luminance, the pixel cells are caused to transfer in state from on mode to off mode only in a last one of the sub-fields of the particular sub-field group, while, when the luminance represented by the video signal is greater than the predetermined luminance, the pixel cells are caused to transfer in state from on mode to off mode in only one of sub-fields of the particular sub-field and subsequent sub-field groups.

13. A display panel driving method according to claim 1, wherein, when the video signal represents a luminance higher in level than the predetermined luminance, the display panel is driven according to pixel data representing a luminance higher in level than a luminance represented by the video signal.

14. A display panel driving method according to claim 13, wherein different ones of offset data are added respectively to those of pixel data corresponding to the pixel cells belonging to the display lines adjacent, and dither values corresponding to pixel positions of within a pixel cell groups having a plurality of pixel cells adjacent horizontally and vertically of the display panel are added to those of pixel data corresponding to pixels of within the pixel cell group.

15. A display panel driving method according to claim 14, wherein the offset data are added when the video signal is higher in luminance than the predetermined luminance level.

16. A display panel driving method according to claim 14, wherein the dither value is increased when the video signal is higher in luminance level than the predetermined luminance.

* * * * *